US010337517B2

(12) United States Patent
Schofield et al.

(10) Patent No.: US 10,337,517 B2
(45) Date of Patent: Jul. 2, 2019

(54) GAS TRANSFER VACUUM PUMP

(71) Applicant: Edwards Limited, West Sussex (GB)

(72) Inventors: Nigel Paul Schofield, Horsham (GB); Ian David Stones, Felbridge (GB); Stephen Dowdeswell, Warninglid (GB)

(73) Assignee: Edwards Limited, West Sussex (GB)

( * ) Notice: Subject to any disclaimer, the term of this patent is extended or adjusted under 35 U.S.C. 154(b) by 840 days.

(21) Appl. No.: 14/374,106

(22) PCT Filed: Jan. 24, 2013

(86) PCT No.: PCT/GB2013/050149

§ 371 (c)(1),
(2) Date: Jul. 23, 2014

(87) PCT Pub. No.: WO2013/110936

PCT Pub. Date: Aug. 1, 2013

(65) Prior Publication Data

US 2015/0037137 A1 Feb. 5, 2015

(30) Foreign Application Priority Data

Jan. 27, 2012 (EP) ..... 12152880
Jan. 27, 2012 (GB) ..... 1201380.1
Feb. 16, 2012 (GB) ..... 1202698.5

(51) Int. Cl.
*F04D 17/06* (2006.01)
*F04D 17/16* (2006.01)
(Continued)

(52) U.S. Cl.
CPC ..... *F04D 17/168* (2013.01); *F04D 17/06* (2013.01); *F04D 19/04* (2013.01); *F04D 19/042* (2013.01);
(Continued)

(58) Field of Classification Search
CPC .... F04D 19/042; F04D 29/185; F04D 29/188; F04D 29/384; F04D 29/544; F04D 19/04; F04D 17/06; F04D 17/168
(Continued)

(56) References Cited

U.S. PATENT DOCUMENTS 852,947 A 5/1907 Gaede
1,492,846 A 5/1924 Holweck
(Continued)

FOREIGN PATENT DOCUMENTS

CN 85105304 A 9/1986
CN 101517240 A 8/2009
(Continued)

OTHER PUBLICATIONS

European Search Report dated Dec. 13, 2012 and Communication dated Apr. 23, 2013 for corresponding Application No. 12152880.6.
(Continued)

*Primary Examiner* — Christopher Verdier
(74) *Attorney, Agent, or Firm* — Westman, Champlin & Koehler, P.A.; Theodore M. Magee

(57) ABSTRACT

An improved vacuum pump mechanism is described in which an intersecting solid or perforated element is arranged to intersect a channel member. Relative movement of the intersecting solid or perforated element and channel member causes gas molecules to be urged from inlet to an outlet of the pump. Gas molecules are constrained within the channel member and interaction of the gas molecules with the flat and smooth surfaces of the intersecting solid or perforated member influence momentum of the gas molecules so that they are directed towards the outlet. In one embodiment, the channel member is formed as a helix and the intersecting solid or perforated elements are disk-shaped. An alternative embodiment is provided having the channel member con-
(Continued)

figured as a spiral and the perforated elements as cylindrical skirts. The pump provides significant improvements in pump capacity, reduced power consumption and size of pump.

25 Claims, 23 Drawing Sheets

(51) Int. Cl.
*F04D 19/04* (2006.01)
*F04D 29/18* (2006.01)
*F04D 29/38* (2006.01)
*F04D 29/54* (2006.01)

(52) U.S. Cl.
CPC ..... *F04D 29/185* (2013.01); *F04D 29/188* (2013.01); *F04D 29/384* (2013.01); *F04D 29/544* (2013.01); *F04D 19/044* (2013.01); *F04D 19/046* (2013.01)

(58) Field of Classification Search
USPC ..... 415/90
See application file for complete search history.

(56) References Cited

U.S. PATENT DOCUMENTS 2,918,208 A * 12/1959 Becker ..... F04D 19/042 415/100
3,020,102 A * 2/1962 Becker ..... F04D 19/042 384/318
3,623,826 A * 11/1971 Mandell ..... F04D 29/384 415/199.5
3,644,051 A * 2/1972 Shapiro ..... F04D 29/324 415/100
3,659,958 A * 5/1972 Schulte ..... F04D 19/042 415/100
4,059,494 A 11/1977 Yanagida et al.
4,309,143 A 1/1982 Klatt et al.
4,732,529 A 3/1988 Narita et al.
4,770,574 A * 9/1988 Lotz ..... B23D 45/003 408/1 R
4,890,980 A 1/1990 Heald et al.
5,033,936 A * 7/1991 Shinojima ..... F01D 5/02 415/199.5
5,052,887 A 10/1991 Novikov et al.
5,074,747 A * 12/1991 Ikegami ..... F04D 17/168 415/55.1
5,154,572 A 10/1992 Toyoshima et al.
5,158,426 A * 10/1992 Casaro ..... F04D 19/042 403/340
5,344,282 A 9/1994 Schofield
5,350,275 A 9/1994 Ishimaru
5,358,373 A * 10/1994 Hablanian ..... F04D 17/168 415/194
5,374,160 A * 12/1994 Hablanian ..... F04D 17/168 415/173.1
5,417,544 A 5/1995 Mohn
5,482,430 A * 1/1996 Hablanian ..... F04D 17/168 415/90
5,490,761 A * 2/1996 Hablanian ..... F04D 17/168 415/55.5
5,498,125 A * 3/1996 Hablanian ..... F04D 17/168 415/55.1
5,577,881 A * 11/1996 Hablanian ..... F04D 17/168 415/55.1
5,595,473 A 1/1997 Nagaoka et al.
5,688,106 A 11/1997 Cerruti et al.
5,695,316 A 12/1997 Schutz et al.
5,772,395 A 6/1998 Schofield
5,848,873 A 12/1998 Schofield
5,893,702 A 4/1999 Conrad et al.
5,904,469 A * 5/1999 Cerruti ..... F04D 29/023 415/90
5,971,725 A 10/1999 de Simon et al.
6,109,864 A * 8/2000 Schofield ..... F04D 29/544 415/199.5
6,126,391 A 10/2000 Atraghji et al.
6,158,986 A 12/2000 Casaro et al.
6,273,696 B1 8/2001 Kosters et al.
6,334,754 B1 1/2002 Kabasawa
6,368,091 B1 4/2002 Mito
6,375,413 B1 4/2002 Stones
6,375,443 B1 4/2002 Yoshimura
6,409,468 B1 6/2002 Kawasaki
6,422,829 B1 7/2002 Schutz
6,461,123 B1 10/2002 Lotz
6,474,940 B1 * 11/2002 Yamauchi ..... F04D 19/042 415/199.5
6,508,631 B1 1/2003 Smith et al.
6,554,593 B2 4/2003 Mito et al.
6,607,351 B1 8/2003 Hablanian
6,890,146 B2 * 5/2005 Blumenthal ..... F04D 29/544 415/143
6,964,560 B2 11/2005 Yoshimura
7,021,890 B2 4/2006 Ishigaki et al.
7,311,491 B2 12/2007 Desbiolles
7,445,422 B2 * 11/2008 Hablanian ..... F04D 17/168 415/143
7,824,153 B2 * 11/2010 Akimoto ..... F04D 19/042 415/191
8,070,419 B2 12/2011 Helmer et al.
8,109,744 B2 2/2012 Kawasaki et al.
8,147,222 B2 4/2012 Mordehai et al.
8,152,442 B2 4/2012 Helmer et al.
2001/0022941 A1 9/2001 Maejima
2001/0041134 A1 11/2001 Iwane et al.
2001/0055526 A1 12/2001 Kawasaki
2002/0025249 A1 2/2002 Iwane
2003/0044270 A1 3/2003 Stanzel
2003/0082059 A1 5/2003 Olivier et al.
2003/0124011 A1 7/2003 Wang et al.
2003/0185667 A1 10/2003 Englander et al.
2004/0013514 A1 1/2004 Englander
2004/0027019 A1 2/2004 Yashiro et al.
2004/0247465 A1 12/2004 Yoshimura
2005/0002776 A1 1/2005 Davis
2005/0013710 A1 1/2005 Stanzel
2005/0025640 A1 2/2005 Sekiguchi et al.
2005/0042118 A1 2/2005 Sekiguchi et al.
2005/0084403 A1 4/2005 Liepert et al.
2005/0106005 A1 5/2005 Mokler
2005/0207884 A1 9/2005 Conrad et al.
2005/0220606 A1 * 10/2005 Beyer ..... F04D 29/324 415/90
2005/0220655 A1 10/2005 Cho
2005/0249618 A1 11/2005 Nonaka et al.
2006/0024184 A1 2/2006 Nakamura et al.
2006/0034713 A1 2/2006 Lee
2006/0263205 A1 11/2006 Kawasaki et al.
2007/0081889 A1 4/2007 Englander
2007/0081893 A1 * 4/2007 Huntley ..... F04D 19/042 415/229
2007/0243059 A1 10/2007 Davis
2008/0056885 A1 3/2008 Hablanian
2008/0056886 A1 3/2008 Hablanian
2008/0118351 A1 5/2008 Akimoto et al.
2008/0193303 A1 8/2008 Stones
2009/0035123 A1 2/2009 Stones
2009/0196734 A1 8/2009 Kawashima et al.
2009/0208354 A1 8/2009 Crisi et al.
2009/0246048 A1 10/2009 Kawasaki et al.
2009/0283674 A1 11/2009 Pesch
2010/0068054 A1 3/2010 Tollner et al.
2010/0158672 A1 6/2010 Helmer et al.
2010/0266426 A1 10/2010 Hablanian
2011/0027069 A1 2/2011 Couto et al.
2011/0243758 A1 10/2011 Bissell
2012/0057995 A1 3/2012 Schofield
2012/0093636 A1 4/2012 Homstvedt et al.

(56) References Cited

U.S. PATENT DOCUMENTS

| | | | | |
|---|---|---|---|---|
| 2012/0240340 | A1* | 9/2012 | Driscoll, Jr. ..... | A47C 27/082 5/710 |
| 2013/0045094 | A1 | 2/2013 | Giors et al. | |
| 2016/0319716 | A1 | 11/2016 | Mitsuda et al. | |

FOREIGN PATENT DOCUMENTS

| | | | | |
|---|---|---|---|---|
| DE | 10004271 | A1 | 8/2001 | |
| DE | 102010028061 | A1 | 10/2011 | |
| DE | 10124339 | B4 * | 10/2016 | ..... F04D 19/042 |
| EP | 0568069 | A2 | 11/1993 | |
| EP | 0682750 | A1 | 11/1995 | |
| EP | 0856108 | A1 | 8/1998 | |
| EP | 0967395 | A2 | 12/1999 | |
| EP | 1795756 | A1 | 6/2007 | |
| EP | 2251547 | A2 | 11/2010 | |
| EP | 2253851 | A2 | 11/2010 | |
| EP | 2295812 | A1 | 3/2011 | |
| EP | 2620649 | A1 | 7/2013 | |
| GB | 332879 | | 7/1930 | |
| GB | 811858 | | 4/1959 | |
| GB | 885954 | | 1/1962 | |
| GB | 936175 | | 9/1963 | |
| JP | S53120578 | A | 10/1978 | |
| JP | S60088892 | | 12/1980 | |
| JP | S58132133 | A | 8/1983 | |
| JP | S60188892 | A | 9/1985 | |
| JP | S6435096 | A | 2/1989 | |
| JP | S6435096 | | 3/1989 | |
| JP | S6477990 | A | 3/1989 | |
| JP | H0135096 | | 10/1989 | |
| JP | H06147184 | A | 5/1994 | |
| JP | H1077990 | A | 3/1998 | |
| JP | 2005519236 | A | 6/2005 | |
| JP | 2006077713 | A | 3/2006 | |
| JP | 2012082634 | A | 4/2012 | |
| JP | 2015087125 | A | 5/2015 | |
| RU | 2016256 | C1 | 7/1994 | |
| SU | 1689664 | A1 | 11/1991 | |
| WO | 2005045249 | A1 | 5/2005 | |
| WO | 2009109020 | A1 | 9/2009 | |
| WO | 2010133866 | A1 | 11/2010 | |
| WO | 2011092674 | A1 | 8/2011 | |

OTHER PUBLICATIONS

British Search Report dated Jun. 15, 2012 for corresponding British Application No. GB1202698.5.

British Search Report dated Jun. 1, 2012 for corresponding British Application No. GB1201380.1.

PCT International Search Report for corresponding PCT Application No. PCT/GB2013/050149.

PCT Written Opinion for corresponding PCT Application No. PCT/GB2013/050149.

Examination report dated Nov. 17, 2014 for corresponding British Application No. GB1202698.5.

Examination Report dated May 6, 2015 for corresponding British Application No. GB1201380.1.

Prosecution history for corresponding Chinese Application No. 201380006640.7 including: First Office Action dated Nov. 3, 2015 and Search Report dated Oct. 14, 2015.

Prosecution history for corresponding Japanese Application No. 2014-553801 including: Notification of Reason for Rejection dated Dec. 12, 2016.

Notification of Reason for Rejection dated Aug. 14, 2017 for corresponding Japanese Application No. 2014-553801.

* cited by examiner

Space chord ratio, S:H ≥4
l:t ≥10:1
or ≥20:1

GAS TRANSFER VACUUM PUMP

CROSS-REFERENCE TO RELATED APPLICATION

This Application is a Section 371 National Stage Application of International Application No. PCT/GB2013/050149, filed Jan. 24, 2013, which is incorporated by reference in its entirety and published as WO 2013/110936 A2 on Aug. 1, 2013 and which claims priority of British Application No. 1201380.1, filed Jan. 27, 2012, European Application No. 12152880.6, filed Jan. 27, 2012 and British Application No. 1202698.5, filed Feb. 16, 2012.

BACKGROUND

The present invention relates to vacuum pumps of the gas transfer type. In particular, but not exclusively, the present invention relates to a new type of drag vacuum pump mechanism.

In general, vacuum pumps can be split into various categories according to their pumping mechanism. Thus, in broad terms, a vacuum pump can be categorized as either a gas transfer pump or an entrapment pump. Gas transfer pumps can be further classified as kinetic pumps or positive displacement pumps (which includes reciprocating pumps and rotary displacement pumps such as Roots or rotary vane mechanisms). Kinetic pumps can also be further classified as drag pumps (such as molecular drag pumps or turbo-molecular pumps) or fluid entrainment pumps (such as oil vapour diffusion pumps).

In order to achieve a certain level of vacuum pressure, different types of pumps can be arranged to operate in series in order to compress low pressure gases to pressures at or just above atmospheric pressure. The different classification of pumps used in such a pumping arrangement depends on many factors, including the level of vacuum pressure required, the application requiring a vacuum environment, the volume of material to be pumped within a certain timeframe and the material being pumped through the vacuum pump, for instance.

Gas transfer vacuum pumps are currently used in many different industrial and scientific applications. For instance, gas transfer pumps provide vacuum for the manufacture of semiconductor devices, including, but not limited to the manufacture of integrated circuits, microprocessors, light emitting diodes, flat panel display and solar panels. These applications require a relatively sterile or benign environment in order to enable deposition and processing of material on a substrate. In addition, gas transfer pumps are used in other industrial processes that require vacuum, including glass coating, steel manufacture, power generation, vacuum distillation, lithium ion battery production and the like. Some scientific instruments, such as mass spectrometers or electron beam microscopes, also require vacuum environments and gas transfer pumps are often used to achieve a suitable vacuum environment.

Various types of gas transfer pump mechanisms have been developed over time. Different pump mechanisms were developed according to the requirements of the application and as a result of different flow behaviour of gas molecules at different vacuum pressures. For instance, at high vacuum pressures ($10^{-3}$ mbar and below) the gas molecules are said to be in a molecular flow regime. Here, the molecules move freely without mutual hindrance and collisions are mainly with the walls of a vessel. Molecules strike the vessel's wall, stick for a relatively short period, and then leave the wall's surface in a new and unpredictable direction. The flow of gas is random and the mean free path is relatively large. In molecular flow regimes, pumping occurs when molecules migrate into the vacuum pump of their own accord. At vacuum pressure in the region of atmospheric pressure to about 1 mbar, the gas molecules behave in a different manner Δt these higher pressures, the flow is called viscous flow. Here the gas molecules collide with one another frequently and the mean free path of the molecules is relatively short. Turbulent and laminar flow conditions exist in this pressure regime. The pressure regime between molecular and viscous conditions is termed transitional flow regime (from about 1 mbar to $10^{-3}$ mbar).

However, there is no known single type of pump mechanism that can operate at required high efficiency across all the vacuum pressure regimes. Thus, in order to evacuate a chamber to a high level of vacuum pressure ($10^{-6}$ mbar, for instance), a vacuum pump system might include a turbo-molecular pump (which are designed to operate efficiently at pressures between $10^{-9}$ to $10^{-2}$ mbar) backed by a molecular drag pump mechanism (which operate efficiently in the transitional flow regime) and further backed by a scroll, Roots or screw pump (which operate efficiently in the viscous flow regime and exhaust gas at atmospheric pressures), depending on the application requirements.

Certain molecular drag mechanisms were developed in the first half of the $20^{th}$ Century and subsequently optimized. However, the fundamental arrangement of the various drag mechanism configurations has remained unchanged, save for the developmental design tweaks. In essence, drag pump action is produced by momentum transfer from a relatively fast moving rotor surface directly to gas molecules contained within a channel defined by a stator. The mechanisms have taken the names of their principle developers.

For instance, in the Gaede pump mechanism shown in FIG. 1 (which is named after Wolfgang Gaede 1878-1945) gas molecules are forced to traverse a set of rotating impeller disks 1, each of which is rotating in close proximity to a stationary gas channel 2 whose inlet 3 and outlet 4 are separated by a stationary stripper member 5 that urges molecules away from the rotating disk at the outlet and into the inlet of the next stage (also see patent documents U.S. Pat. No. 852,947 and GB190927457).

The Holweck pump mechanism shown in FIG. 2 generally comprises a smooth sided cylinder 6 spinning in close proximity to a helical grooved outer wall 7 and is named after Fernand Holweck, (1890-1941). The tangential velocity of the cylinder imparts momentum to the gas molecules which are propelled within the grooved channels along the helical path towards an outlet 4. Multiple grooved surfaces are commonly used (reference can be made to U.S. Pat. No. 1,492,846 for more details). In alternative Holweck configurations, the smooth sided cylinder can form the stator and the rotor can be configured as the helical grooved component.

In a Siegbahn pump mechanism, as shown in FIG. 3, the rotor generally comprises a spinning disk 8 to impart momentum to the gas molecules. The stator comprises spiral channels on its surface held close to the rotating disk. Thus, gas molecules are forced to travel along the inwardly spiralling radial channels. This mechanism was developed by Mane Siegbahn (1886-1978) and is further described in patent document GB332879.

A more detailed explanation of these known mechanisms and their additional incarnations is not necessary here because the skilled person is familiar with them. The various mechanisms form part of the common general knowledge of the person skilled in the art of vacuum pump technology, with further explanation found in various books on the subject. For example, reference can be made to the following textbooks: "Modern Vacuum Practice", by Nigel Harris, published by McGraw-Hill in 2007 (ISBN-10:0-9551501-1-6); "Vacuum Science and Technology", edited by Paul A Redhead, published for the American Vacuum Society by AIP Press in 1994 (ISBN 1-56396-248-9); and "High-Vacuum Technology—A Practical Guide", by Mars Hablanian, published by Marcel Dekker Inc in 1990 (ISBN 0-8247-8197-X).

Both Holweck and Siegbahn mechanisms are commonly used as backing pumping mechanisms for turbo-molecular pump mechanisms. Advantageously, the Holweck or Siegbahn rotor can be integrally coupled to the turbo-molecular pump's rotor thereby allowing for a single rotor and drive motor design. Such pump mechanisms are referred to as compound turbo-molecular pumps and examples of this type of pump are disclosed in U.S. Pat. Nos. 8,070,419, 6,422,829 and EP1807627, for example.

However, known molecular drag mechanisms suffer from various drawbacks. For instance, the capacity of the pump mechanism is limited because the rotor has to rotate relatively close to the stator and the depth of the stator channel has to be relatively shallow in order to optimize the compression ratio of the pump. In known drag pump mechanisms, it is not possible to increase capacity by increasing the depth of the stator channel beyond a certain limited. The system being evacuated is at a lower gas pressure than at the pump's exhaust and gas naturally tries to flow back through the pump into the evacuated system to equalize any pressure gradient. If the stator channel is too deep, then gas molecules in a portion of the channel furthest from the rotor can be unaffected by the rotor. Thus, a path for gas molecules to flow back along the channel against the intended flow direction towards the inlet of the drag pump stage can be provided when the channel is too deep resulting in a significant loss of pump efficiency and compression ratio.

There is a desire to increase the capacity of drag mechanism vacuum pumps. This might be achieved by providing several drag mechanisms arranged in a parallel configuration, such as the system disclosed in U.S. Pat. No. 5,893,702. Here, concentric Holweck pump stages are arranged to work in parallel with one another. However, the additional rotor weight, inertia, complexity and overall pump size required by this type of configuration can make it undesirable.

Turbo-molecular pumps comprise a series of rotor blades that extended in a generally radial direction from a rotor axle or hub. A series of rotor blade sets are stacked on top of one another along the axis of rotation. The blades are angled to direct gas molecules struck by the rotating towards an outlet. It is conventional to place stator blades in-between each rotor blade set to improve pump efficiency and reduce backflow of gas molecules towards the pump inlet. The stator blades are generally designed along the same principles as the rotor blades, but the stator blades are angled in an opposite direction. The rotor and stator blades can be machined from a metal block or formed from a sheet of metal having the blades stamped out of the sheet. The skilled person is familiar with this type of vacuum pump and further description of the mechanisms is not necessary here. Alternative turbo-molecular pump designs have been proposed that can be described as radial flow turbo-molecular pumps, such as those shown in US2007081889, U.S. Pat. No. 6,508,631 and DE10004271.

Both axial and radial flow turbo-molecular vacuum pumps are efficient only in the molecular flow regime pressures because the pump relies on high speed rotors imparting momentum to gas molecules and directing the molecules towards the outlet. At higher pressures, that is in the transitional and viscous flow regimes where gas molecules interact with one another as well as part of the pump, turbo-molecular pumps become much less efficient. This reduction in efficiency is manifested as an inability of turbo-molecular pumps to provide an effective compression ratio of gases at relatively low vacuum pressures. In effect, at low vacuum pressures (i.e. in the transitional and viscous flow pressure regimes) the gas molecules can become 'trapped' in-between the blades of a rotor or stator as a result of interacting with neighbouring gas molecules rather than the parts of the pump designed to direct molecules towards an outlet. Thus, at these higher pressures, the pump can suffer from a so-called 'carry over' where gas molecules are not effectively transferred along the axial length of the pump towards the outlet but tend to remain in the space between neighbouring rotor blades and travel in a generally circumferential path.

The discussion above is merely provided for general background information and is not intended to be used as an aid in determining the scope of the claimed subject matter.

SUMMARY

The present invention aims to provide a vacuum pump mechanism that ameliorates the issues discussed above. Additionally, the present invention aims to provide a vacuum pump mechanism that has a relatively high pumping capacity, operates at lower consumption levels and/or requires relatively less space compared to known pump mechanisms with the same or similar specification. In other words, the present invention aims to provide a more efficient vacuum pump in terms of gas throughput, cost of ownership and/or overall pump size.

In order to try and achieve this aim, the present invention is, in broad terms, directed towards a pump mechanism in which two elements are arranged for relative movement with respect to one another and where a first element provides a channel defining a gas flow path between an inlet and outlet and a second element intersects the channel at an angle, wherein the second element is either perforated to allow gas to flow through it or is solid and arranged to allow gas to flow around it and, during use, the relative movement urges gas molecules in the channel towards the outlet. The second element should be relatively thin (for example less than 1 mm thick for a perforated second element) and have smooth and/or flat surfaces. If a solid second element is utilized then the thickness of the element is less critical and might be in the region of 2 mm or less. To try and minimize 'carry-over' of gas molecules, the first element (that defines the gas flow channel) should extend to a position that is relatively close, or as close as possible to the surface of the second element. This arrangement can be utilized so that a majority of gas molecules remain within the gas flow channel at the point where the second element intersects the channel and are not carried over by the second element as it passes out of the channel. The second element can intersect the channel at a position along the length of the channel or at the channel's outlet or inlet. The term "perforated" is taken to mean that a perforated element comprises gas permeable apertures arranged to allow gas through the element.

Thus, the combination of the first and second elements provides a molecular drag pump arrangement. However, the present invention can be seen to differ from known molecular drag pumps (as described above) in that known systems generally operate with the plane of the stator and rotor being arranged in parallel or the components being arranged concentrically. In broad terms, one element of the present invention's pumping mechanism operates in a different plane to the other element. In other words, one element passes through the gas flow path defined by the other element and gas can pass along the flow path by virtue of the perforations or gaps provided for the passage of gas molecules through or around one of the elements.

More precisely, in a first aspect of the present invention there is a vacuum pump or pump rotor comprising an intersecting member (a solid or perforated element) being arranged such that, during use, the intersecting member influences the momentum of a gas molecule interacting with the intersecting member and wherein the intersecting member is arranged to allow the passage of gas molecules past it via a gap or plurality of perforations. The intersecting member can be a solid device (having a transparency value of zero) or a perforated element having a plurality of perforations that allow gas molecules to flow through the perforated element. The perforations can be enclosed by the edges of the perforated element, or open at the edges of the perforated element. In other words, open perforations are not enclosed by the edge of the perforated element.

The perforated element or intersecting member can be arranged to intersect a portion of a gas flow path in a pump. The perforated element or intersecting member can comprise an upstream surface facing the pump inlet and a downstream surface facing the pump outlet arranged such that the upstream and downstream surfaces of the perforated element or intersecting member can be free from protrusions. In other words, the surfaces are smooth or generally flat without elements extending from the surface. The perforated element can be either a perforated disk or a perforated cylinder. The surfaces of the disk or cylinder are flat, in that the surfaces are free of protrusions. The term "flat" is taken to mean that surfaces are said to be flat even when a tapering perforated element is utilized and/or the perforations are disposed on a curved surface of a tapered disk or cylinder—the surfaces do not comprise protrusions extending out of the flat or curved plane of the perforated element.

The upstream and downstream surfaces of the perforated element or intersecting member can provide the means by which momentum is transferred to the gas molecules. Thus, molecules passing through a pump comprising such a rotor interact with the rotor's upstream and downstream surfaces and are urged towards an outlet.

The perforations disposed through the perforate element can include holes having a circular, elongate, ovoid, hexagonal, rectangular, trapezoid, or polygonal shape. Furthermore, the perforated element can comprise a peripheral edge and at least a portion of the perforations are open at the peripheral edge. That is, the perforations are not enclosed by the peripheral edge. In addition, open perforations can extend in a radial direction towards an inner circumferential edge, whereby a portion of the upstream and downstream surfaces disposed between neighbouring open ended perforations extends towards the peripheral edge to form a flat radial vane.

Advantageously, the perforated element or intersecting member can have a thickness of less than 1.5 mm, preferably less than 1 mm and more preferably less than 0.5 mm. The thickness is measured as a distance between the upstream and downstream surfaces.

In addition, the perforated element comprises an annular array of perforations passing through the perforated element to interconnect upstream and downstream surfaces. The perforations can extend through the perforated element in a direction perpendicular to a surface of the disk. Thus, perforations extend through the perforated element to allow the passage of gas there through and have an interaction length equivalent to the thickness of the perforated element at the location of the perforation.

Additionally, the perforated disk can comprise an annular portion in which the plurality of perforations is disposed and the transparency of the annular portion varies in a radial direction. The transparency can increase with respect to increasing radial distance from the centre of the disk. Furthermore, the transparency varies as a function of either varying the size of perforation, varying the angular spacing of perforation, varying the circumferential spacing of perforations, or any combination thereof. Transparency is taken as the ratio of the total area of the perforated element intersecting a gas flow channel that is taken up by the perforations of the perforated element (i.e. excluding the area taken up by perforated element's material) to the total area of a member that intersects a given flow path channel.

In addition, a spindle can be coupled to the perforated element or intersecting member, said spindle being arranged coaxially therewith. The spindle can be arranged to be coupled to a plurality of perforated elements (or intersecting members) and/or each of the plurality of perforated elements or intersecting members can be disposed at discrete locations along the axial length of the spindle. In addition, the spindle can be arranged to have a diameter that varies along the axis of rotation to form an axial profile that is anyone of frustoconical, stepped, bullet-shaped, and cylindrical, or any combination thereof. Furthermore, the diameter of the spindle can increase along the axial length towards a pump outlet. This arrangement can aid gas compression within a pump comprising a plurality of rotor elements arranged in series.

Advantageously, the perforated elements or intersecting members can be spaced apart by cylindrical spacing elements so that a first element comprising a perforated disk or intersecting member is disposed nearest to an inlet of a pump and second element comprising a perforated disk or intersecting member is disposed nearest to an output of a pump. The first perforated disk can have a higher or lower transparency compared to the second perforated disk. This arrangement can be utilized if the desired inlet pressure is in the molecular flow pressure regime and the outlet pressure is in the transitional or viscous flow pressure regimes and to maximize gas compression within the pump. The perforated elements can be coupled to the spindle via the spacing elements to allow for accurate spacing of perforated elements. A combination of perforated elements and solid intersecting members can be arranged throughout the pump—for instance, the first element might comprise a perforated element and the second element might comprise a solid intersecting member or vice versa.

The perforated disk can comprise an annular portion in which the plurality of perforations is disposed and a solid inner portion disposed between the annular portion and the centre of the disk arranged so that the solid inner portion forms an inner periphery of the disk. In one arrangement the solid inner portion of the second perforated disk extends in a radial direction further from an axis of rotation when compared to a solid inner portion of the first perforated disk. Additionally, the perforated disk can comprise an annular portion in which the plurality of perforations is disposed and a solid outer portion forming the outer periphery of the disk.

Advantageously, a turbo-molecular blade section can be disposed for use upstream of the perforated element or intersecting member. Additionally, other pumping mechanisms, such as regenerative pump mechanism, Siegbahn, Holweck or Gaede drag mechanisms or a centrifugal pump rotor section can be disposed for use downstream of the perforated element.

Furthermore, the rotor can be made from a material including aluminium, aluminium alloy, steel, carbon fibre re-enforced polymer (CFRP), or titanium.

Additionally or alternatively, there is provided a vacuum pump or a vacuum pump stator arranged to cooperate with a vacuum pump rotor, comprising; a channel member or element having a surface on which a gas flow channel is disposed, said channel being formed of at least side walls and a floor, wherein the side walls comprise an intersecting slot arranged to accommodate an intersecting member or perforated element that intersects the gas flow path at an intersection angle and wherein the channel is arranged to constrain gas therein, and wherein the intersecting member or perforated element and channel element are moveable with respect to one another. The perforated element is configured to allow the passage of gas through it and the intersecting member is arranged to allow the passage of gas past it, as described above. The intersection angle can be an acute angle or perpendicular to a portion of the gas flow channel wall through which the rotor element passes.

Advantageously, the channel member can be cylindrical and the gas flow channel is formed as a helix disposed on an inner surface of the cylinder. In this configuration, the sidewalls of the channel can be disposed on the inner cylindrical surface of the channel member and extend from the inner surface towards a longitudinal axis; and/or the intersecting slot can extend in a radial direction towards a longitudinal axis of the channel member. Thus, this configuration provides a stator for use in an axial flow pump. Alternatively, the channel member can be disk-shaped and the gas flow channel is formed as a spiral disposed on an upper surface of the of the channel member. In this configuration, the flow channel can extend between the outer periphery of the channel member and a position close to a radial axis of the disk-shaped channel member; and/or the intersecting slot can extend along an arc a constant distance from the radial axis. Thus, this configuration provides a stator for use in a radial flow pump.

Depending on the desired pump characteristics, the intersecting slot can extend from the floor of the gas flow channel. Alternatively, the slot can extend to a position short of the floor of the gas flow channel. In both cases, the slot is arranged to accommodate a rotor and if the rotor does not completely intersect the gas flow channel (i.e. there is a small gap left between the peripheral edge of the rotor and the channel floor) then the alternate configuration can be utilized.

Advantageously, the channel member can be arranged to form a portion of a stator, said stator comprising two or more stator elements fixed to one another. Each of the stator elements can be identical to one another. Furthermore, each stator element can comprise an abutment surface arranged to cooperate with the abutment surface of a neighbouring stator element. Further still, the intersecting slot can be disposed at a location coinciding with the abutment surface. The plane of the intersecting slot can be arranged to be perpendicular to the abutment surface. Thus, the stator can comprise segments that are relatively easy to assemble to form a complete stator.

Advantageously, a portion of the gas flow channel of one stator element can be arranged to overlap with a portion of the gas flow channel of a neighbouring stator element. Additionally, this configuration also allows for respective overlapping portions of the gas flow channel to be arranged to overlap and form the intersecting slot in the sidewall of the gas flow channel.

Advantageously, the vacuum pump or pump stator can comprise two or more gas flow channels arranged to extend from an inlet towards an outlet. As a result, a multiple start pump is provided wherein a stator configured in this way provides means for having a multiplicity of inlets to maximize throughput of gas. Preferably, between six to twenty gas flow channels can be arranged to extend from an inlet towards an outlet. The number of starts depends on the diameter of the pump mechanism, amongst other factors.

Additionally or alternatively, the gas flow channels can be arranged in a stepped configuration whereby the gas flow channel comprises radial and longitudinal sections interconnected to one another. The slot for accommodating the rotor can be configured to coincide with the longitudinal section such that the slot is generally perpendicular to the rotor.

Of course, various aspects of the present invention are described above as a rotor and stator, respectively. However, the present invention can also provide a stator having the features of the rotor described in the first aspect, or a rotor having the features of the stator described in the second aspect above.

Additionally, there is provided a vacuum pump having a mechanism comprising; an intersecting member or a perforated member arranged to intersect a channel formed on a surface of a channel member, said channel being arranged to guide gas molecules from an inlet of the pump towards an outlet, wherein the intersecting member (or perforated member) and channel member are arranged to move relative to one another so that, during use, gas molecules are urged along the channel towards the outlet, said intersecting member or perforated member being arranged to allow gas molecules to pass around or through it. The intersecting member or perforated member can intersect the channel at an acute angle or at a 90-degree angle.

The channel member can comprise a slot, disposed in a wall of the channel, arranged to accommodate the perforated member at a point where the perforated member intersects the channel. The slot can extend across at least the depth of the channel so that the perforated member can completely divide the channel at the point where the perforated member intersects the channel. Alternatively, the slot does not extend to the floor of the channel and the perforated member intersects only a portion of the gas flow channel thereby leaving a gap in the gas flow channel at the point of intersection. Put another way, the perforated member can be arranged to extend across the gas flow channel to intersect a majority of the channel, whereby a gap is provided between the perforated member such that, during use, the gas molecule can pass through the gap.

Alternatively, the slot does not extend to the floor of the channel and the intersecting member intersects only a portion of the gas flow channel thereby leaving a gap in the gas flow channel at the point of intersection. The gap is disposed between the inner or outer circumference and a portion of the channel and the gap extends around the outer or inner circumference of the intersecting member. Put another way, the intersecting member can be arranged to extend across the gas flow channel to intersect a majority of the channel, whereby a gap is provided between the intersecting member such that, during use, the gas molecule can pass through the gap and around the intersecting member. Thus, the intersecting member can be solid (that is without perforations) and the circumferential gap provides the means by which gas molecules can be transferred or urged past the intersecting member. The gap can be disposed between the outer peripheral circumference of the intersecting member and the channel when the intersecting member is arranged as a rotor and the channel is arranged as a stator for a pump. Alternatively, the gap can be disposed between the inner peripheral circumference of the intersecting member and the channel when the intersecting member is arranged as a stator element and the channel member is the rotor of a pump.

Advantageously, the channel member can be cylindrical and the channel is formed on an inner surface to form a helical gas flow path between the inlet and outlet disposed at opposing ends of the channel member. Furthermore, the perforated member can be a perforated disk in this configuration. The disk can be tapered with smooth or flat surfaces, free from protrusions. Thus, the thickness of the perforated member can be minimized, along with the slot's width through which the disk passes to reduce carry-over of gas molecules. In other words, the width dimension of the slot is comparable to the thickness of the perforated member so as to restrict or minimize the amount of gas that can be carried over within the perforations or through the slot.

Additionally, the perforated member is a rotor and the channel member is a stator. The rotor can be arranged according to any of the configurations described in the first aspect above.

The channel member can comprise a radial surface on which the channel is formed to provide a spiral gas flow path between an inner and outer circumference of the radial surface. Thus, the perforated member can be a perforated cylinder. The perforated cylinder can be arranged concentrically with the channel member, whereby an intersecting slot extends along a circular path and a rotor can be accommodated within a slot. This arrangement allows for radial flow of gas molecules being pumped through the vacuum pump.

Advantageously, a turbo-molecular bladed rotor can be disposed upstream of the channel member. This provides a means of further encouraging gas molecules into the pump mechanism, particularly in molecular flow pressure regimes.

The vacuum pump can further comprise a third pumping stage disposed downstream of the channel member. The third pumping stage can comprise any one centrifugal pumping stage, a Holweck drag mechanism, Siegbahn drag mechanism, Gaede drag mechanism, or regenerative pump mechanism. The third pumping mechanism can be arranged to exhaust at pressure near to or above atmospheric pressure.

Additionally, the perforated or intersecting member comprises an upstream surface facing the pump inlet and a downstream surface facing the pump outlet. The upstream and downstream surfaces of the perforated or intersecting member can be free from protrusions. In other words, the surfaces are flat or smooth. The perforated member can be either a perforated disk or a perforated cylinder. The perforated member can comprise a peripheral edge and at least a portion of perforations are open at the peripheral edge. The open perforations can extend in a radial direction towards an inner circumferential edge, whereby a portion of the upstream and downstream surfaces disposed between neighbouring open-ended perforations extend towards the peripheral edge to form a flat radial vane. The perforated or intersecting member has a thickness of less than 2 mm or 1.5 mm, preferably less than 1 mm and more preferably less than 0.5 mm. Furthermore, perforations in the perforated member can extend through the perforated member in a direction perpendicular to a surface of the disk. Thus, the carry-over of gas molecules can be minimized and the pump's efficiency improved.

Additionally, the present invention provides a vacuum pump comprising; an inlet, an outlet, either a perforated member or an intersecting member, a channel member, and a motor; wherein the channel member comprises a surface having a channel formed thereon, said channel being arranged to guide gas molecules from the inlet towards the outlet, the perforated member or intersecting member is arranged to intersect the channel, the perforated or intersecting member comprises upstream and downstream surfaces which are free of protrusions, a portion of the perforated or intersecting member that intersects the channel has a thickness of less than 2 mm, and the motor is arranged to cause relative movement of the perforated or intersecting member and channel member such that, during use, the relative movement causes gas molecules to be urged along the channel towards the outlet, said perforated or intersecting member allowing gas molecules to pass through or around it.

In addition, there is also a vacuum pump mechanism comprising: a rotor coupled to a driving motor and being rotatable about an axis along which gas molecules can be pumped, and a stator arranged concentrically to the axis, wherein the stator and rotor each extends longitudinally around the axis between first and second ends for a predetermined length and the rotor comprises a first surface arranged to face a second surface of the stator, the stator comprises a third surface disposed on and extending from the second surface to the first surface to form a helical gas flow path between an inlet at the first ends of the stator and rotor and an outlet at the second ends of the stator and rotor, the rotor comprising a gas permeable disk-shaped radial member disposed at the outlet and extending between the first and second surfaces, the radial member being arranged to rotate and impart momentum to gas molecules and wherein the radial member is axially displaced from an end portion of the third surface by less than 2 mm.

Furthermore, the present invention also provides a vacuum pump mechanism comprising: a first pumping element arranged to cooperate with a second pumping element to urge gas molecules from an inlet towards an outlet, the said first and second pumping elements being arranged to move relative to one another about an axis, the first pumping element having a first surface arranged around the axis facing a second surface of the second pumping element to form a gap between the first and second surface, the first pumping element further comprising an annular screen extending from the first surface across the gap to the second surface, said screen being permeable to gas molecules, the second pumping element further comprising a helical wall disposed on the second surface extending across the gap to the first surface forming a helical path between the first and second surfaces along which pumped gas molecules can migrate, wherein the annular screen is disposed downstream of the helical wall.

In addition, a pump according to the present invention can comprise at least two intersecting elements spaced apart along the axis of the channel member in series by a distance l, each element has a thickness t, and either the ratio of l:t is 5:1 or greater, 10:1 or greater, or the ratio of l:t is 20:1 or greater. Furthermore, the intersecting element can have a thickness that is 0.02 or less than its diameter, more preferably the intersecting element's thickness is less than 0.01 or less than its diameter. Further still, a plurality of vanes can extend from the channel member to define a helical channel, the vanes being arranged in stages having an intersecting element disposed between adjacent stages, and wherein the space chord ratio of vanes within the same stage is greater than or equal to 4, and the space chord ratio of vanes at the output is either 5 or greater, or 6 or greater.

The Summary is provided to introduce a selection of concepts in a simplified form that are further described in the Detail Description. This Summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention are now described by way of example and with reference to the accompanying drawings, of which.

DETAILED DESCRIPTION

The present inventive concept is now described by way of various embodiments. However, it is understood by the skilled person that each embodiment described is not a distinct or discrete representation of the inventive concept, but rather elements from one embodiment can be combined with elements from another without leaving the scope of the invention. Additionally, the present inventive concept is described in terms of a pump. Again, it is readily understood by the skilled person that the mechanisms described herein can form discrete stand-alone pumps or one or more components of a compound vacuum pump.

Figure 1:
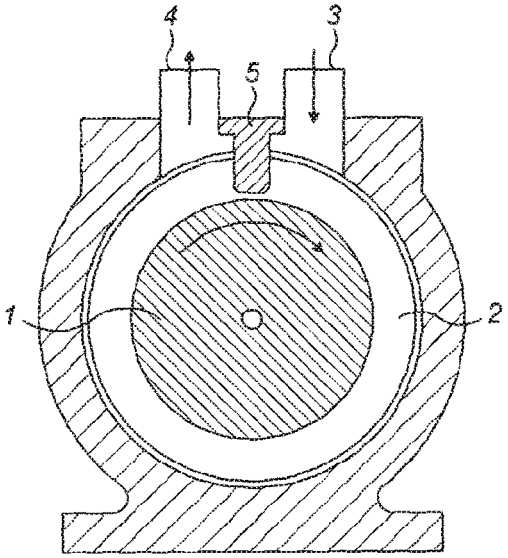
FIG. 1 (PRIOR ART)
FIGS. 1, 2 and 3 are schematic diagrams of known molecular drag pumping mechanisms.
Figure 2:
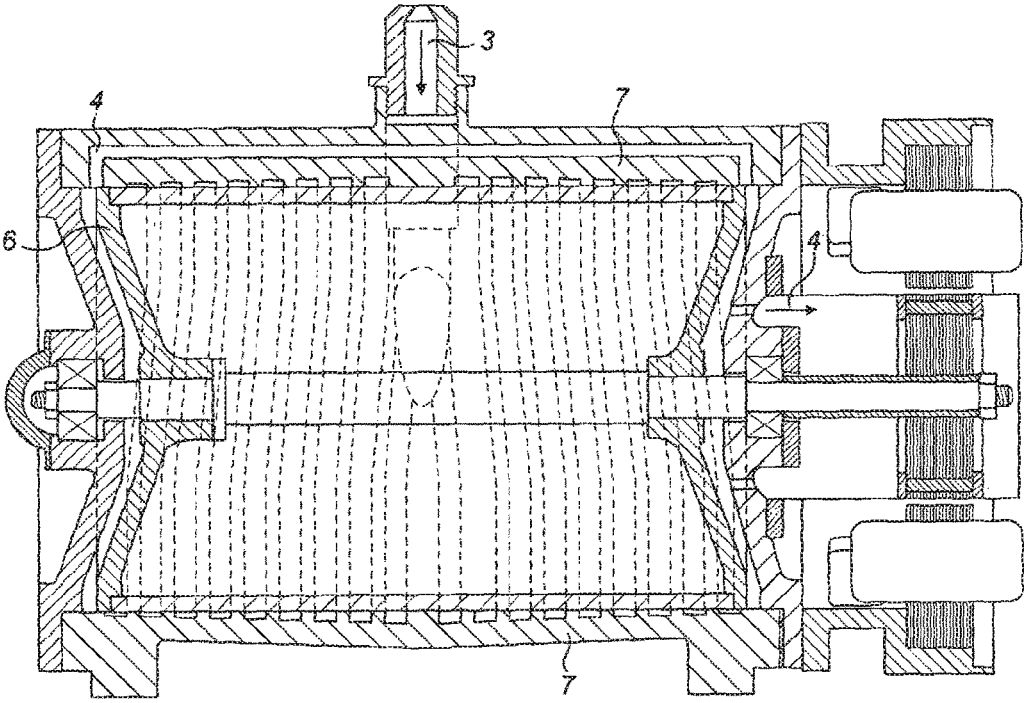
FIG. 2 (PRIOR ART)
Figure 3:
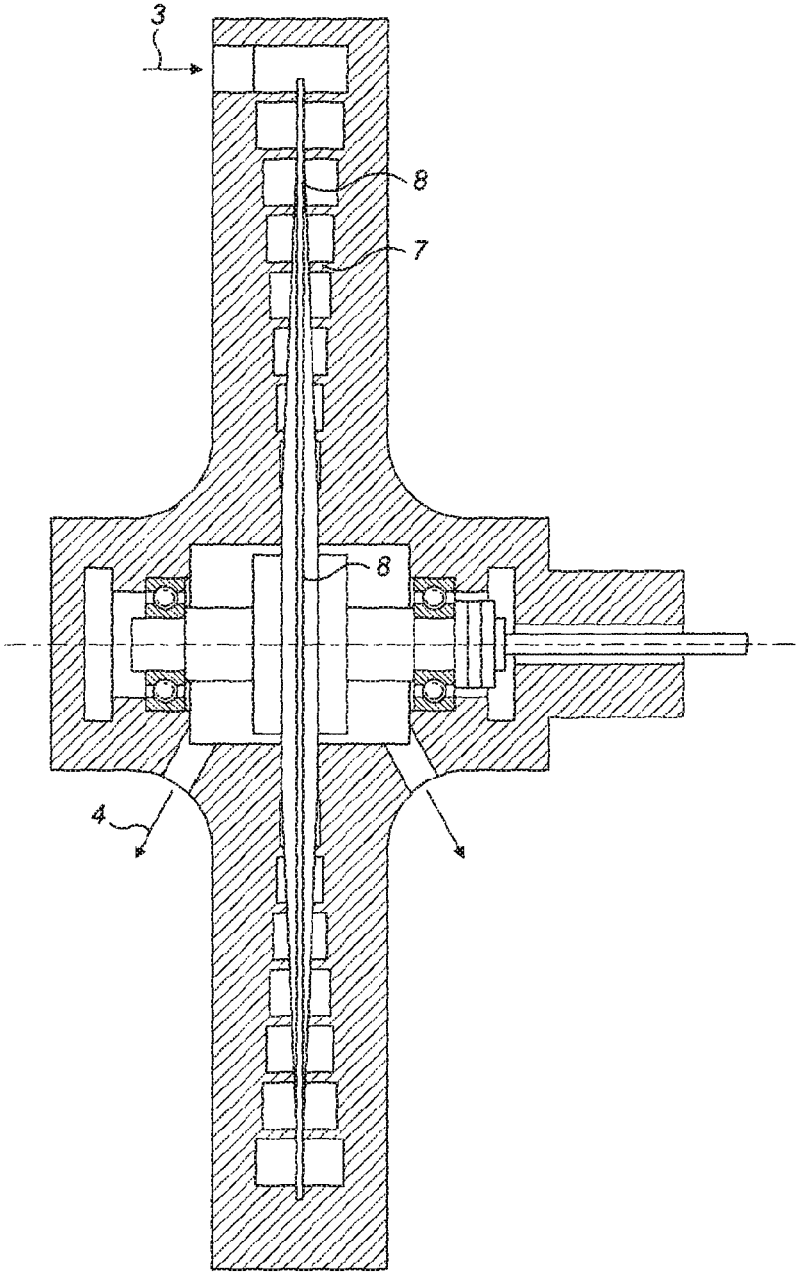
FIG. 3 (PRIOR ART)
Figure 4:
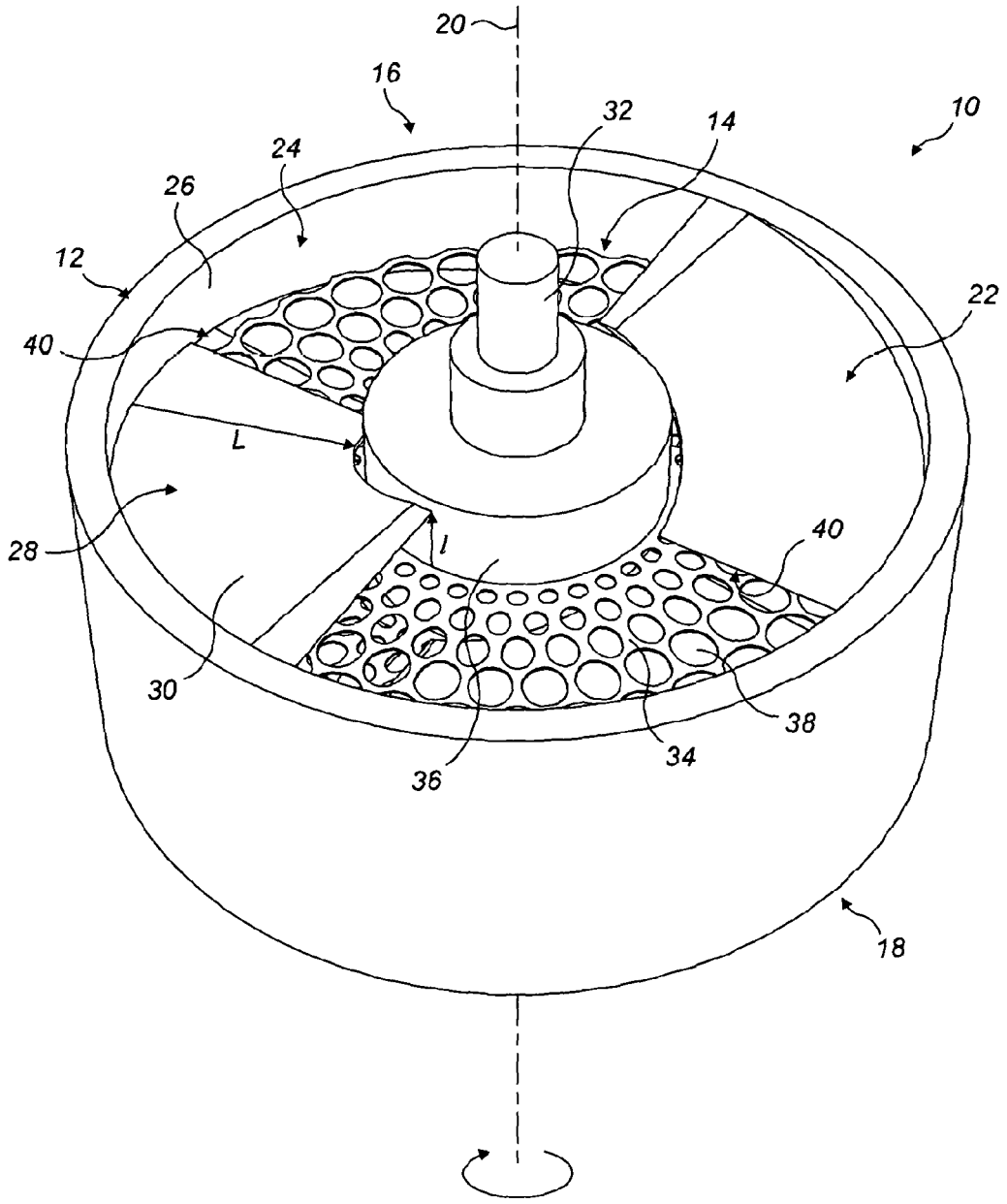
FIG. 4 is a schematic diagram of an embodiment of the present invention.

A first embodiment of the present invention is shown schematically in FIGS. 4 to 7. Referring to FIG. 4, a vacuum pump mechanism 10 is shown comprising a channel element 12 and a perforated intersecting element 14. The channel element and perforated intersecting element are moveable with respect to one another in order to urge gas molecules entering the pump's inlet 16 towards an outlet 18. Such relative movement can be provided by holding one of the elements stationary whilst the other is driven in a rotary motion by an electric motor (for instance). For the purposes of this embodiment, we shall describe the pump mechanism in terms of the channel element being the stationary component of the pump (that is, the stator) and the perforated element as being the rotating, driven element of the pump (that is, the rotor). Of course, the present invention is not limited to this arrangement and the skilled person understands that the other configurations are possible where the channel element is driven whilst the perforated element remains stationary or is also driven to provide the required relative motion.

In the first embodiment, the channel member (stator) 12 is generally cylindrical in shape, having the inlet 16 disposed at one end of the cylinder's axis 20 and the outlet 18 disposed at the other, opposite end. Thus, this embodiment can generally be described as an axial flow pump. At least one channel 22 can be formed on the inner surface 24 of the cylinder. The embodiment shown in the figures illustrates two channels to provide a so-called 'two start' pump, or 'twin start'. Of course, more channels can be formed if desired, as discussed below. The channel is formed of a floor 26 and sidewalls 28 extending from the floor towards the axis to form a helical flow path. The floor coincides with the inner cylindrical surface of the cylinder. The channel's sidewalls extend by a distance L in a radial direction, which can typically be of the order of a few millimeters to 100 mm or more, depending on the pump's operational requirements. In the twin start configuration shown, there are two flow paths forming a double helix. The sidewalls 28 of the channel are formed integrally with helical vanes 30 that extend from the inner surface 24 of the cylinder. One side of the vane forms a sidewall of a first channel and the other side of the vanes forms a sidewall of a neighbouring channel.

The perforated intersecting element 14 (rotor) comprises a spindle 32 that can be coupled to a motor to drive the rotor. A disk 34 is mounted on the spindle and is positioned and held in place by use of a spacer element 36. The disk is relatively thin, having a thickness in the axial direction of less than 2 mm, more preferably less than 1.5 mm and most likely in the region of 0.75 to 0.25 mm thick. An array of perforations 38 is provided on the disk 34 to allow gas molecules to pass through the disk, from one side to the other side, via the perforations. The perforations are arranged to pass straight through the disk and are not inclined to the rotor or disk's surface. The disk is arranged to intersect the gas flow path at an angle, thus the perforations are required to allow the gas molecules to pass through the radial plane of the disk and continue along the flow path. A slot 40 is provided in the channel element to accommodate the disk and allow the disk to intersect the channel. As a result, the channel extends either side of the disk and the disk divides the channel into an upstream portion nearest the inlet and a downstream portion downstream of the disk.

Figure 18:
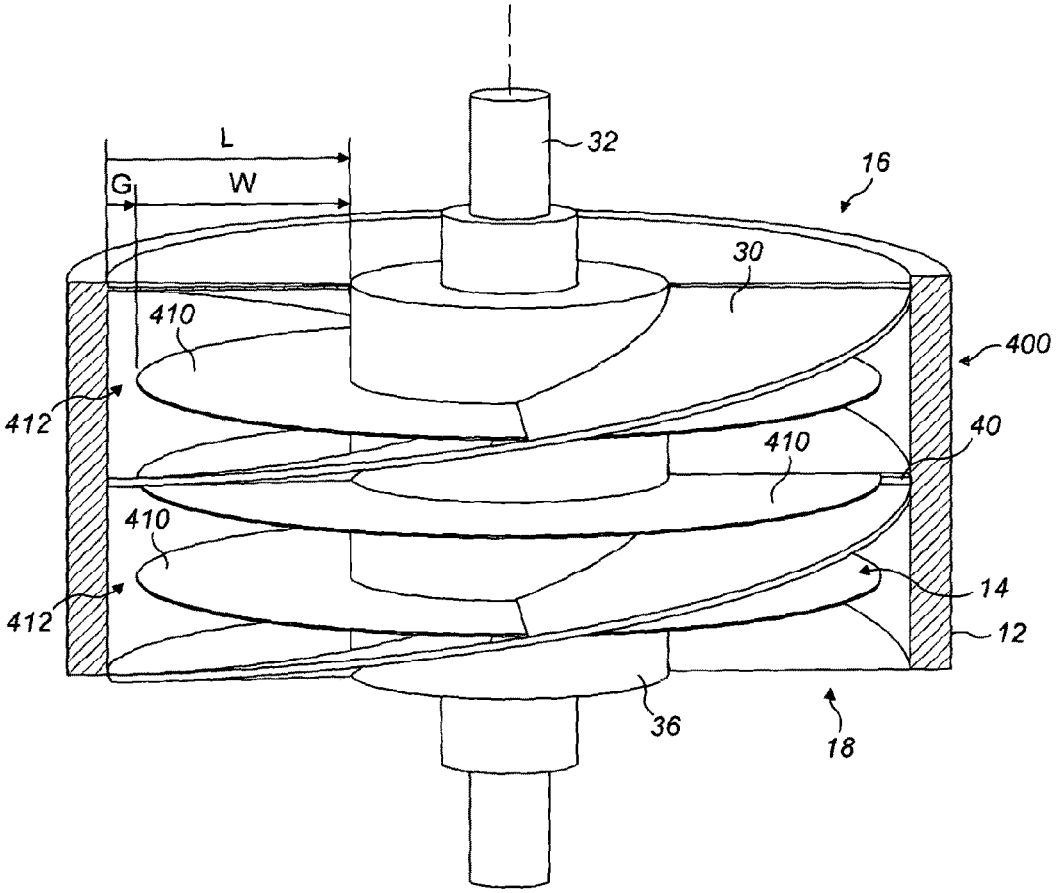

The rotor disk is disposed a short distance '1' from the start of the gas flow channel sidewall. In other words, the sidewall extends above the rotor at the inlet of the gas flow channel by a distance T in an axial direction. Therefore, the inlet has a cross-section of dimensions Ll in the radial and axial plane, where L width dimension of the gas flow channel as shown in FIGS. 4 and 18. The distance 'l' can be between 5 to 40 mm or larger. As a result, when compared to known drag pump mechanisms described above, it is apparent that the capacity of the pump mechanism embodying the present invention is greatly improved. As discussed above, known drag pump mechanisms are limited in their ability to pump relatively large volumes of gas, whereas a pump embodying the present invention can overcome this limitation by utilizing this configuration where one element intersects the gas flow channel at a given angle. A cross-sectional area of the gas flow channel in the order of a few hundred $mm^2$ to 4,000 $mm^2$ or more is readily achievable using the present invention. The dimension l can also be used when measuring the distance between adjacent perforated elements in the pump and the cross-sectional area of the gas flow path in-between rotor disks is also measured as Ll.

Figure 5:
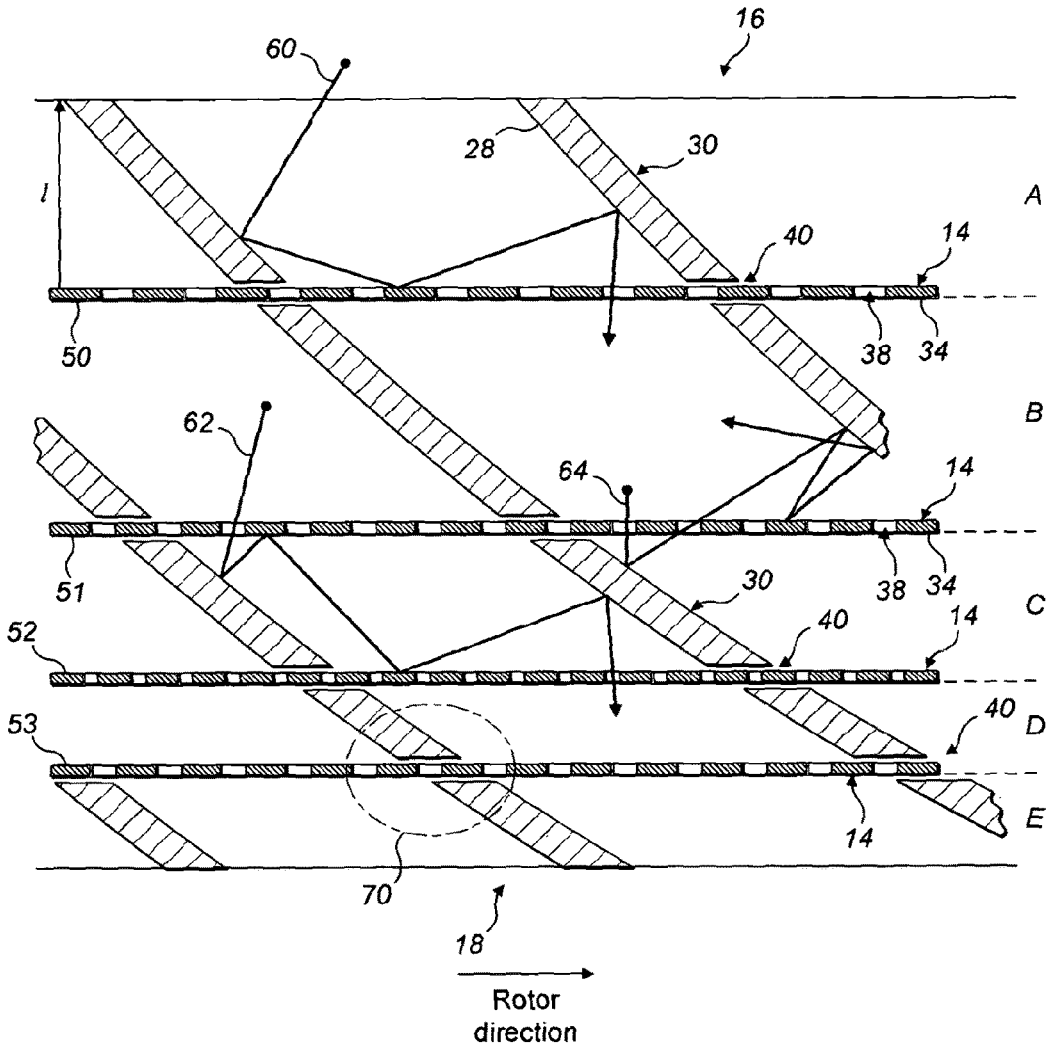
FIG. 5 is a schematic diagram of a portion of the pump mechanism embodying the present invention.

FIG. 5 is a circumferential cross-section of a portion of the mechanism shown in FIG. 4 and illustrates the operational principles of a pump embodying the present invention. When in operation, the disk is rotated at relatively high speed about the axis 20, as indicated by the arrow in FIG. 5. In FIG. 5, the principles of operation show the components of the pump in a linear manner to help ease the understanding of the operation principles. As a result, the rotational movement of the disk is shown as a linear movement as indicated by the arrow. Further, FIG. 5 shows schematically a vacuum pump embodying the present invention having four rotor disks dividing the pump into five stages A to E. Stage A is upstream of a first rotor 50, a second rotor 51 divides stages B from C, a third rotor 52 divides stages C from D and a fourth rotor divides stages D from E. Section E terminates at the outlet 18 of the pump downstream of the fourth rotor 53. The rotor disk intersects the flow path channel by passing through the slot 40 disposed in the channel walls. The slot is designed so that the disk passes through the slot with minimal clearance, which is approximately 0.50 mm clearance above and below the surface of the disk closest to the slot 40.

Various possible gas molecule paths are shown in FIG. 5. A first path is illustrated by arrow 60. The molecule enters the inlet of the pump which operates at high vacuum pressure. It strikes the stator wall 30 and is released into the path of the rotor 50. Striking a solid part of the rotor, momentum is imparted to the molecule by the relative movement of the rotor. Next, the molecule strikes the underside surface of the sidewall 28 and it is directed again towards the rotor. Here, the molecule's path interacts with a disk perforation 38 allowing the molecule to pass through the intersecting disk into the next section of the pump, namely section B as illustrated.

A second path of another molecule is illustrated by arrow 62. Here, the molecule's path passes through a perforation on the rotor allowing the molecule to progress from section B to Section C where it then interacts with a sidewall of the channel and is emitted from the surface towards the rotor through which it has just passed. Here, it interacts with the downstream surface of the rotor and it is retained within section C, as a result. Its path then continues from the rotor 51 onto the third rotor 52, from here to the opposite sidewall of the channel and then through a perforation of the third rotor into section D. Thus, momentum can be transferred to gas molecules by either an upstream or a downstream surface of a rotor, or by both surfaces.

A third path of a different molecule is illustrated by arrow 64. Here, the molecule passes from Section B into Section C via a perforation in the second rotor 51 where it settles on the sidewall of the channel. It then returns to section B through a perforation of the rotor when it is emitted from the sidewall. The molecule does not leave section B despite further interaction with the second rotor. Our initial computational modelling of a pump embodying the present inventive concept has shown that this path is relatively unlikely to occur, but it does occur on occasion.

Thus, gas molecules migrating into the inlet of the pump encounter a surface of the rotating disk. Some molecules pass through a perforation and strike a surface of the gas flow path channel 22. However, a significant proportion of the molecules strike one or more surfaces of the rotating disk, settling there for a short time period and then leave the surface in a random direction. The momentum of the gas molecule leaving the surface in this fashion is influenced by the rotary motion of the disk and it is likely that the molecule has momentum transferred to it having a major component in the direction of the rotor's movement. As a result, the majority of molecules striking and leaving the disk's surfaces are urged towards the underside of the channel wall and towards a point where the rotor passes through the channel wall. Thus, molecules are ultimately urged towards the outlet of the pump mechanism by a combination of the intersection of the rotor and gas flow path.

From FIG. 5, it can be seen that the compression of gas increases from stage A to stage E. An increasing reduction of rotor spacing towards stage E and/or increased angle of inclination of the sidewalls with respect to the rotor can assist with maintaining pump efficiency as the gas molecules become compressed towards the outlet. Furthermore, it is likely that different rotor perforation patterns and transparency are employed at different pressures encountered in stages A to E.

Figure 6:
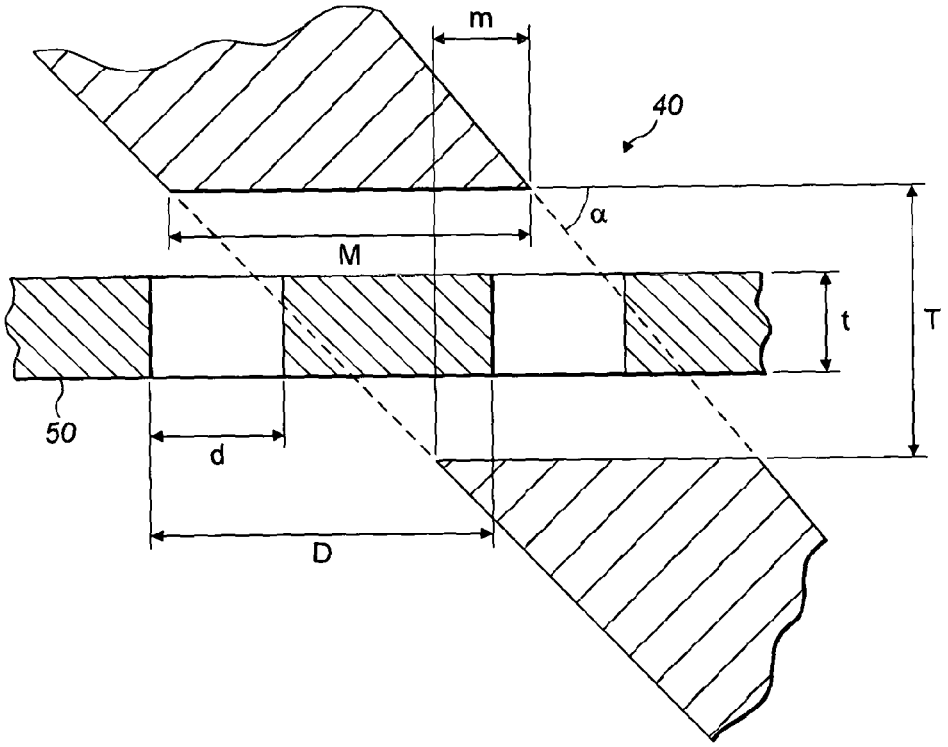
FIG. 6 is an enlargement of a portion of FIG. 5.

FIG. 6 shows an enlargement of area 70 as shown in FIG. 5, where the rotor and sidewalls intersect. The rotor 50 passes through the slot 40 of sidewall 28 at the intersection point. To provide efficient pumping, that is the efficient transfer of gas molecules from one side of the rotor disk to the other, the pump designer should consider minimizing potential return paths for molecules or paths which allow the molecule to effectively remain in the same stages of the pump (i.e. stages A to E as explained above). For example, the width T of the slot 40 should be minimized as far as possible to try and prevent gas flowing from one side of the sidewall to the other side without passing through the perforated element 50. Furthermore, the thickness 't' of the rotor 50 should be minimized in order to reduce the likelihood of gas molecules being transferred within the perforations as it passes through the slot 40 to try and prevent a so-called 'direct carry-over' of gas molecules. Our initial computational modelling results have indicated that a rotor thickness 't' of 1.0 mm to 0.3 mm would provide sufficient pumping efficiency when operated in conjunction with a slot width T of 1.5 to 1.0 mm or thereabouts. Other factors might influence the thickness 't' of the rotor, such as meeting required stiffness and strength parameter to prevent rotor breakage caused by centripetal forces during use or to prevent axial flexing of the rotor caused by vibration or pressure differences across the thickness of the rotor. In other words, the ratio of T:t should be as close to 1 as is practicably possible.

Furthermore, the length M of the slot 40 (as seen by the rotor passing through the slot 40) might affect pumping efficiency, as might the length of overlap 'm'. The overlap depends on angle α at which the rotor disk 50 is inclined with respect to the plane of the channel wall, the length M of the slot and width T of the slot. In addition, the size of the perforations (shown as 'd' in the figure), the spacing D of the perforation and the relative length M of the slot might also affect the pumping efficiency. It is likely that a different ratio of d:M might be required, depending on the pressure of gas being pumped and/or the desired throughput of the pump. For instance, in the viscous flow pressure regime, our initial assessment shows that 'd' should be relatively large, possibly exceeding M, in order to provide efficient pumping. The dimension of 'd' might be reduced in the molecular pressure regime. Thus, different stages of a pump embodying the present invention might use different rotor dimensions and perforation dimensions.

The angle of intersection a is typically measured at a point halfway along the radial distance L, as shown in FIG. 4. The reason for doing this is because the angle varies depending on the radial position at which it is measured. Embodiments of the present invention are likely to utilize an angle α of between 40° to 5° depending on the pressure of gas being pumped and the desired gas flow path length required before molecules encounter subsequent rotor surfaces. Typically, our initial modelling has been conducted for pump mechanisms having an angle α of between 20° and 5°. Of course, different angles can be used, depending on the requirements of the pump.

Furthermore, to provide efficient pumping, the ratio of channel width '1' to slot width T should be maintained at a high level, preferably exceed a value of 5 in the viscous flow regime and exceeding a value of 10 or more in lower pressure regimes. Here, l is used to measure the distance between adjacent perforated elements, as well as the distance between an inlet opening.

FIG. 7 shows segments of different rotors in FIGS. 7*a* to 7*e*. The figures illustrate different examples of perforation types and, of course, the present invention is not limited to these specified perforations and the skilled person understands that different configurations are possible.

Figure 7A:
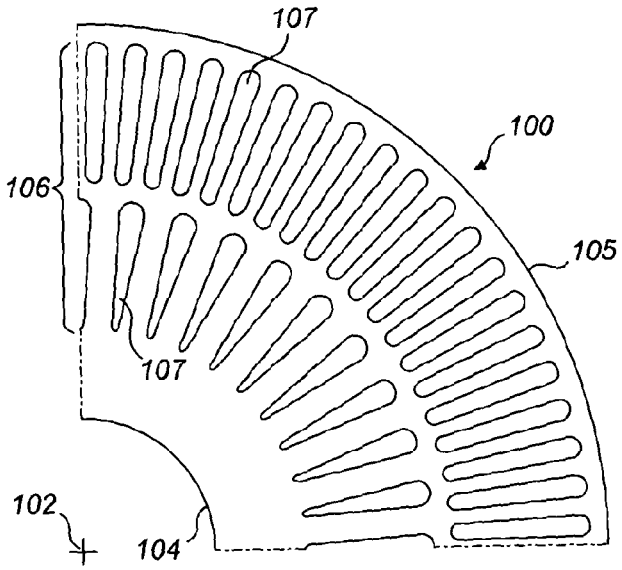
FIG. 7*a* is a schematic diagram showing portions of a perforated member according to the present invention.

In FIG. 7*a*, a quarter segment 100 of a disk rotor as described above is shown. The rotor has an axis 102, inner circumferential edge 104 and outer peripheral edge 105. An array 106 of perforations 107 is provided in annular zone 106. The perforations are arranged as radial slits having a radial length dimension that is much greater than their width or circumferential dimension.

Figure 7B:
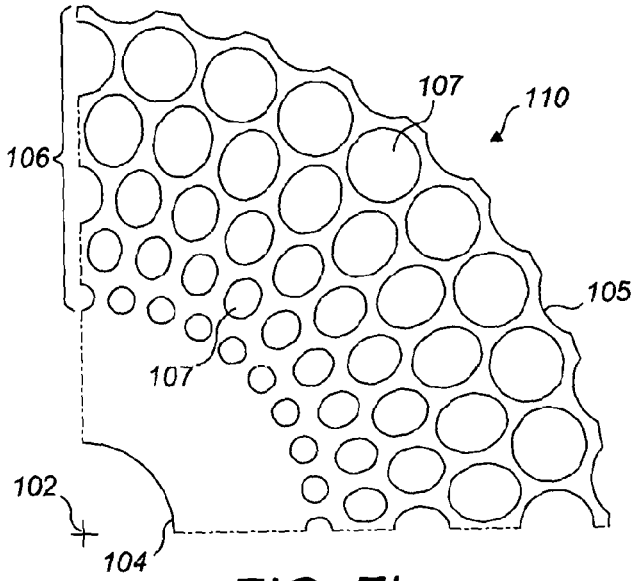
FIG. 7*b* is a schematic diagram showing portions of an alternative perforated member according to the present invention.

FIG. 7*b* shows an alternative embodiment 110, where the same numerals have been used to indicate common features. However, this embodiment differs from the others in that the perforations 107 are circular and/or ovoid in shape. Furthermore, the outer peripheral edge 105 of the rotor disk comprises a rippled edge that enables a reduction in the overall weight of the rotor.

Figure 7C:
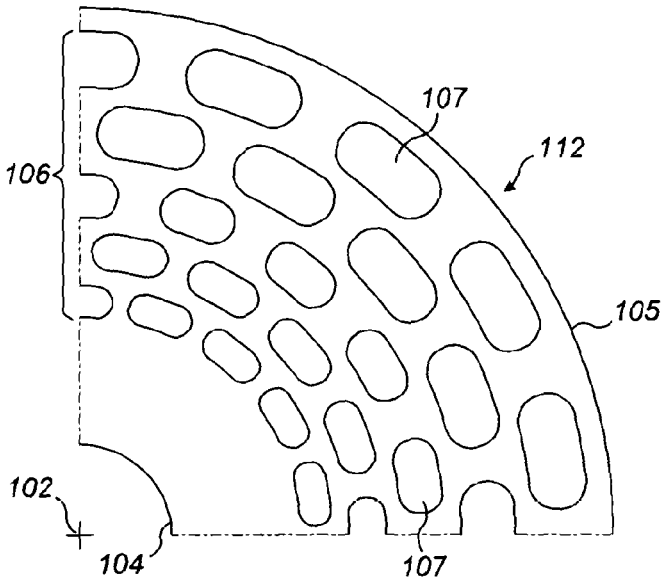
FIG. 7*c* is a schematic diagram showing portions of an alternative perforated member according to the present invention.

FIG. 7*c* shows another alternative embodiment 112, where the same numerals have been used to indicate common features. However, this embodiment differs from the others in that the perforations 107 are lozenge or stadium shaped, extending in a circumferential direction. In addition, the outer peripheral edge can be configured with a rippled or saw-tooth profile (similar to that shown in FIG. 7*b*) to assist with weight reduction.

Figure 7D:
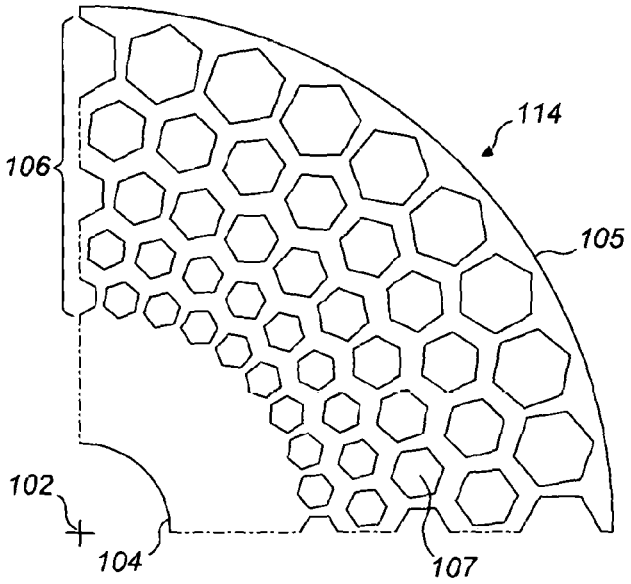
FIG. 7*d* is a schematic diagram showing portions of an alternative perforated member according to the present invention.

FIG. 7*d* shows another alternative embodiment 114, where the same numerals have been used to indicate common features. However, this embodiment differs from the others in that the perforations 107 are hexagonally shaped to provide a more efficient way of spacing the perforations and reducing material bulk between neighbouring perforations. In addition, the outer peripheral edge can be configured with a rippled or saw-tooth profile (similar to that shown in FIG. 7*b*) to assist with weight reduction.

Figure 7E:
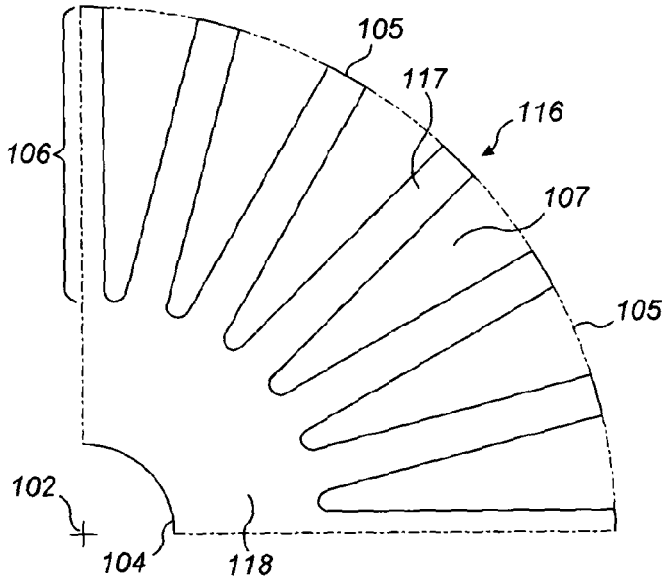
FIG. 7*e* is a schematic diagram showing portions of an alternative perforated member according to the present invention.

FIG. 7*e* shows another alternative embodiment 116, where the same numerals have been used to indicate common features. However, this embodiment differs from the others in that the perforations 107 are open at the outer peripheral edge. In other words, the perforations are slits formed through the disk that extend from a position close to the inner peripheral edge 104 and extending to the outer peripheral edge 105. Put another way, the disk in this embodiment comprises a series of vanes or finger-like portions 117 that have a constant cross-sectional profile (that is, constant width and thickness) and that extend outwards in a radial direction from a hub portion 118. It is noteworthy that the vanes 117 are not turned out of the plane of the flat disk to form angled blades (such an arrangement would be similar to those used in a turbo molecular pumping mechanism): the vanes remain flat in order to maintain minimum thickness of the disk to reduce carry-over of gas molecules as the disk passes through the channel wall. The spaces between the vanes are called perforations for the purposes of this document. The top and bottom surfaces of the vanes provide the means by which momentum is transferred to the gas molecules passing through the pump. This is not the same as the mechanism used in turbo-molecular pump blades where all of the momentum is transferred from to gas molecules as a result of interaction between the molecules and angled surfaces of the rotor blades that are inclined with respect to the radial plane of the turbo rotor.

In all the embodiments shown in FIG. 7, there is an inner annular radial zone adjacent to an outer annular radial zone 106 in which the perforations are disposed. The inner zone comprises solid material, but could equally comprise perforations or other means to reduce the weight of the disk. All the perforations should be disposed in the portion of the disk that intersects the gas flow path. It might also be advantageous to include a portion of the solid annular inner zone in the portion of the disk that intersects the gas flow path.

Additionally, there might also be advantages with configuring the rotor disk to extend across only a portion of the gas flow path, whereby a small outer radial zone in the flow path nearest to the floor of the channel is unoccupied by the rotor. In other words, in this additional embodiment, the rotor does not divide the gas flow or extend across the entire radial width of the channel and hence the gas flow path. We would expect such an outer peripheral gap between the outer peripheral edge of the rotor and the floor of the channel to be in the order of 5 mm to 10 mm Such an arrangement encourages the passage of gas molecules around the outer edge of the rotor along the gas flow path. In addition, when keeping the spacing between the rotor's outer peripheral edge and the channel's floor to less than 10 mm, the rotor's motion can still influence the gas molecules directing or influencing the momentum of the molecules so that they are urged along the gas flow path in the desired direction. In this arrangement, the slot in the gas flow channel side wall which accommodates the perforated element does not have to extend to the floor of the gas flow channel. The slot can terminate at the point where the outer peripheral edge of the rotor is disposed.

Furthermore, in this arrangement, it might not be necessary for the rotor to comprise perforations, in which case a solid intersecting member can replace the perforated intersecting element.

Figure 17:
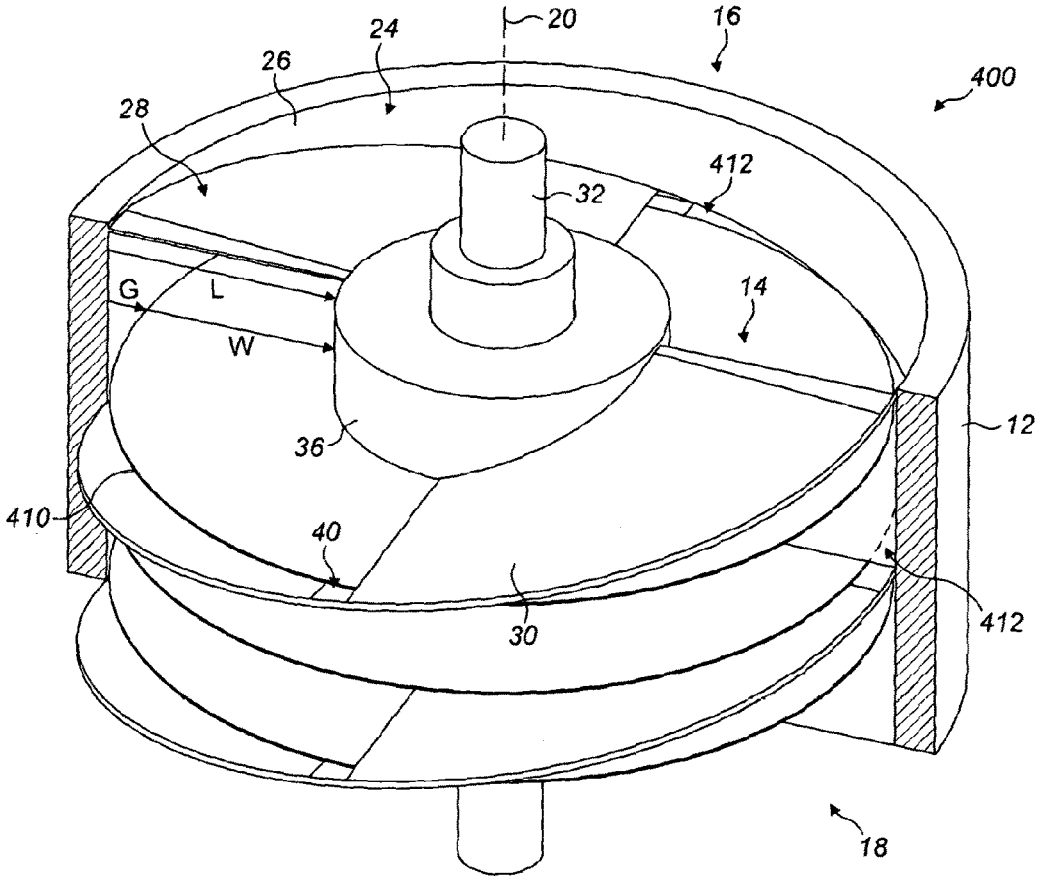
FIGS. 17 and 18 are schematic diagrams of a further embodiment of the present invention.
Figure 19:
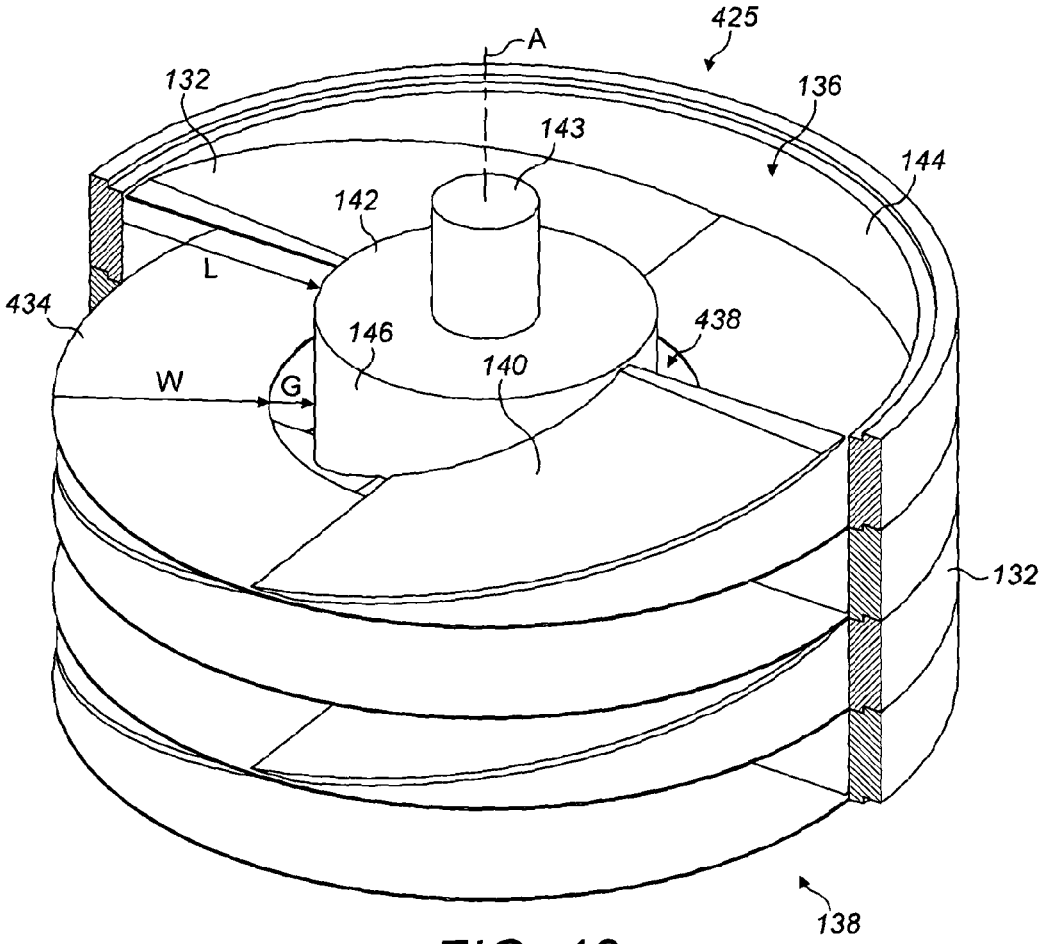
FIG. 19 is a schematic diagram of an alternative embodiment of the present invention shown in FIG. 17.

Embodiments of the present invention comprising a solid intersecting member are shown in FIGS. 17 to 19. Referring to FIGS. 17 and 18, a pump mechanism 400 is shown comprising features that are common with other embodiments described in this document. Such common features have been assigned the same reference numerals. The pump comprises a rotor shaft 32 which is arranged to rotate about an axis 20. A stator 12 comprises a helical gas flow channel as described above with reference to FIG. 4. Slots 40 are provided to accommodate an intersecting element 14 which is disposed on the shaft. The intersecting element is arranged to intersect the flow channel provided by the stator channel components and the surface 36 of the spacer element. In this embodiment, the intersecting element 410 is solid (having a transparency value of zero) and has a width W measured across the width of the helical flow channel. The flow channel has a width dimension L which is greater than W. Thus, a gap 412 having a width dimension G is provided between the outer peripheral circumference of the solid rotor disk 410 and the flow channel, where $$L=W+G$$

and the gap is provided to allow gas molecules to pass around the rotor and continue along the flow channel towards the pump's outlet 18. Referring to FIG. 18, a different view point of this alternative embodiment is provided. The dimension of the gap G can be of the order of 10 mm or thereabouts. Typically, the width dimension W of the intersecting elements is between 80% to 95% of the width dimension L of the flow channel.

The circumferential gap 412 provides the means by which the pumped gas molecules pass the intersecting member on their passage towards the outlet. In such an arrangement, the intersecting member does not allow gas to pass through it because there being no perforations or means for gas to pass through the rotor. Rather, the gap allows passage of gas molecules and the gap between the outer circumference (or peripheral edge) of the rotor and the floor of the channel. The gap 412 can extend around a majority of the rotor's circumference (that is more than 180° and up to 360° around the circumference of the rotor). In alternative arrangements, it might be advantageous for the gap to comprise a series of restricted or choke portions which can provide distinct apertures or open areas that are provided between the circumference of the rotor and the channel floor. In other words, the width of the gap can be arranged vary circumferentially.

The transparency of the perforated member is measured as the ratio of the total area of the member intersecting a gas flow channel that is taken up by the perforations (i.e. excluding the area taken up by the material of the perforated member) to the total area of the member that intersects a given flow path channel. Thus, taking the embodiments shown in FIG. 7 as an example, a transparency of 25% is taken to mean that a quarter of the area of the rotor disk (that is, the perforated member) disposed within the gas flow channel comprises open space, or perforations. In contrast, a transparency of 80% is taken to mean that four-fifths of the area of the perforated member (rotor disk) disposed within the gas flow channel comprises open spaces or perforations.

As described above, momentum is transferred from the rotor to the gas molecules by interaction between the molecules and the upstream or downstream surfaces of the disk—the upstream and downstream surfaces being in the plane of the disk. The disk is thin and only a minimal proportion of gas molecules passing through the perforations between the upstream and downstream surfaces interact with a vertical wall of the perforation. At molecular regime pressure levels, a majority (at least 75%) of gas molecules are likely to pass through a perforation without impacting the wall of a perforation for a disk having a thickness of roughly 0.5 mm. In other words, the leading and trailing edges of the perforations have little effect on the momentum of gas molecules passing through the perforation, particularly in the molecular flow pressure regimes.

The size, spacing distance between perforations, and transparency of the rotor can be varied depending on a number of factors, including the pressure at which the pump or individual pump stage is designed to operate. For instance, in molecular flow, perforation spacing and transparency is less critical to determining pump dynamics because aerodynamic effects do not hinder the passage of gas molecules through the perforations at these low pressures. In other words, boundary layer, shock wave and other effects associated with fluid dynamics in viscous flow pressure regimes either do not exist or are minimized in molecular flow pressure regimes.

In contrast, in viscous flow pressure regimes, perforation size should be arranged to maximize gas transfer through the pumping mechanisms. Also, the transparency should be increased within given mechanical constraints for viscous flow operation. For instance, the size of perforation in a circumferential direction can exceed the width of the slot in the stator side wall. In addition, a gap of 2 to 10 mm can be provided between the inner or outer peripheral edge of the rotor and the floor of the gas flow channel, as described above, in order to assist with providing sufficient or desired gas throughput. Therefore, the dimensions and transparencies of the rotor disks in a multiple stage pump are likely to vary through the pump due to gas molecules becoming compressed as they pass through the pump towards the inlet: the rotor perforation size and pattern at the inlet can vary from the rotor perforation size and pattern at the outlet because the outlet operates at a higher pressure.

Figure 8:
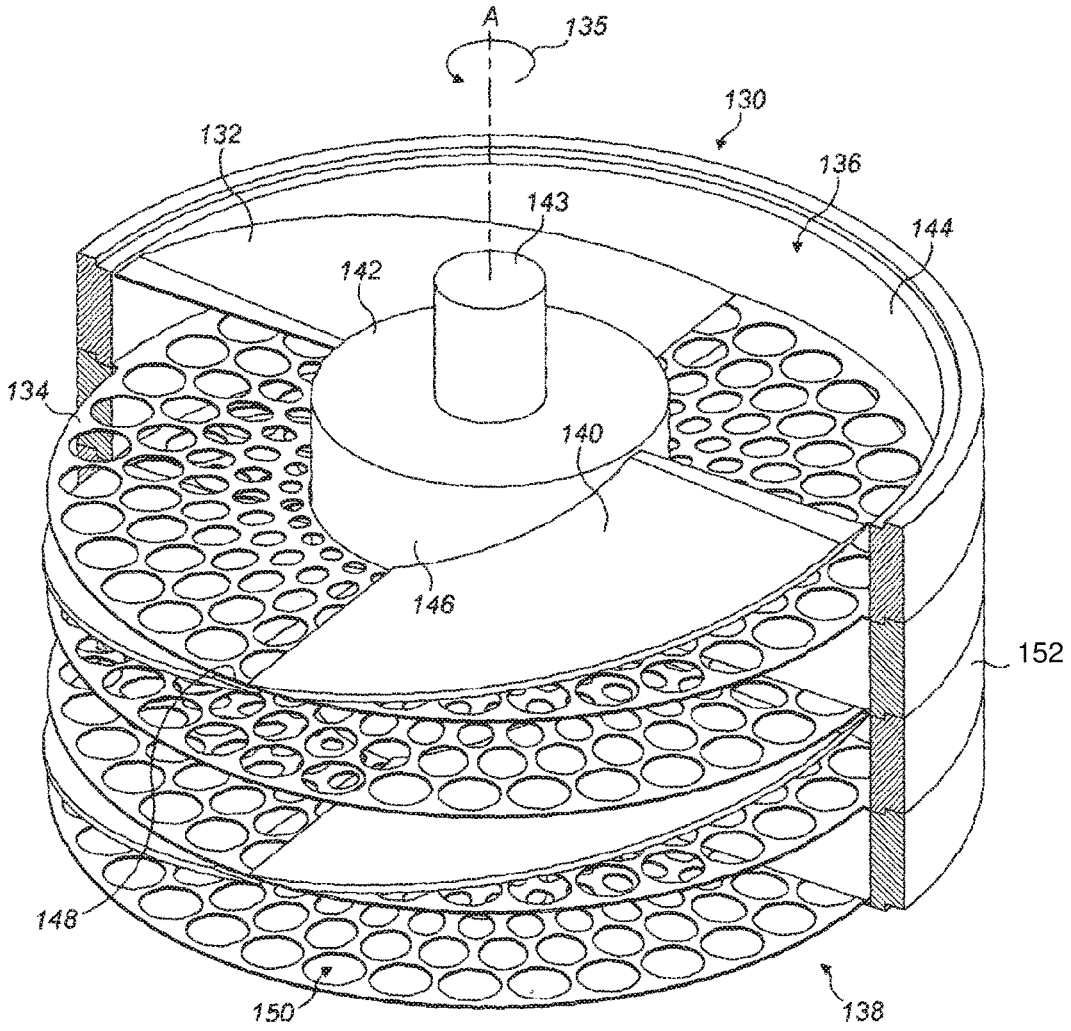
FIG. 8 is a schematic diagram of an alternative embodiment of the present invention.

An alternative embodiment of the present invention is shown in FIG. 8. Here, the pump 130 comprises a rotor 132 and stator 134. The rotor 132 is arranged to rotate relative to the stator 134 about an axis A in the direction shown by the arrow 135. The stator is generally cylindrical in shape and comprises an inlet 136 disposed at one axial end of the cylinder, and an outlet 138 disposed at the other axial end.

The rotor comprises a pair of twin helical blades 140 extending from a central spindle 142 disposed on an axle 143, whereby the spindle is generally cylindrical in shape and is arranged to be coaxial with the stator cylinder. A helical flow path is defined by rotor blades, an inner surface 144 of the stator cylinder and an outer surface 146 of the spindle which extends from the inlet to the outlet. In the example shown in FIG. 8, there are two flow paths forming a double helix, the paths being arranged in parallel with one another. However, one or more flow channels can be provided and the present invention is not limited to the embodiment described here.

The rotor element comprises an intersecting slot 148 arranged to accommodate a perforated stator element 134 that intersects the flow path. In this embodiment, the stator is shown to extend across the entirety of the flow path's width. However, this feature is not essential and a small gap can be provided to assist with gas flow towards the outlet. Perforations 150 in the rotor allow gas to flow through the rotor element and progress along the flow path channel.

Four perforated disks are arranged in 360° turn of the flow path. Any number or perforated disks can be arranged in this fashion, although between 1 and 8 disks per turn is considered sufficient, depending on the specific requirements of the pump. A stacking element 152 is arranged in between each perforated element and acts to space the disks apart by the desired distance and hold the disks in place during operation. The stacking element also provides the inner cylindrical surface 144 of the flow channel.

The operation principles of the various embodiments are similar. Relative motion of the channel and perforated members provides the means to urge gas molecules towards the pump outlet. What differs between the embodiments is the part of the pump that is driven by a motor in a practical engineering solution.

Referring to FIG. 19, an alternative arrangement for a pump 425 is shown where the rotor comprises the helical gas flow channel component and the stator comprises the intersecting element. This embodiment is similar in principle to the one shown in FIG. 8, save for differences with respect to the intersecting member or element. Features common to the embodiment illustrated in the figures have been assigned the same reference numerals. In this embodiment 425, the intersecting element 434 forms part of the stator 136, and the rotor 140 comprises a helical channel disposed on a rotor shaft 143, 146. The rotor has a width dimension of L. The gas flow channel is intersected by a solid intersecting member 434 extending into the flow channel by a distance W, wherein W>L. Thus, a gap 438, having a width dimension G, is provided between the inner peripheral edge of the intersecting member 434 and rotor, where $$L=W+G$$

and the gap is provided to allow gas molecules to pass around the intersecting stator member and continue along the flow channel towards the pump's outlet 18. As described above, and with reference to FIGS. 17 and 18, the dimension of the gap G can be of the order of 10 mm or thereabouts. Typically, the width dimension W of the intersecting elements is between 80% to 95% of the width dimension L of the flow channel.

The circumferential gap 438 provides the means by which the pumped gas molecules pass the intersecting member on their passage towards the outlet. In such an arrangement, the intersecting member does not allow gas to pass through it because there being no perforations or means for gas to pass through the rotor. Rather, the gap allows passage of gas molecules and the gap between the outer circumference (or peripheral edge) of the rotor and the floor of the channel. The gap 434 can extend around a majority of the intersecting member's inner circumference (that is more than 180° and up to 360° around the inner circumference). In alternative arrangements, it might be advantageous for the gap to comprise a series of restricted or choke portions which can provide distinct apertures or open areas that are provided between the rotor and the intersecting member. In other words, the width of the gap can be arranged to vary circumferentially. This configuration allows the stator to be made of two or more parts that are fitted around a central core comprising the rotor.

It is possible that embodiments of the present invention that have a relatively smaller size or which operate at higher pressure may utilize the second embodiment, whereas a relatively large pump or one which operates at lower pressures may utilize the first embodiment. In addition, it may be desirable to provide a hybrid configuration that utilizes both embodiments in the same pump, wherein the low pressure stages and high pressure stages are disposed on the same drive axle, the low pressure stages (molecular flow pressure regime) incorporating the first embodiment and higher pressure stages (transitional and/or viscous flow pressure regimes) incorporate the second embodiment.

A third embodiment is shown schematically with reference to FIGS. 9, 10, 11 and 12, in which an alternative vacuum pump mechanism 180 is shown.

Figure 9:
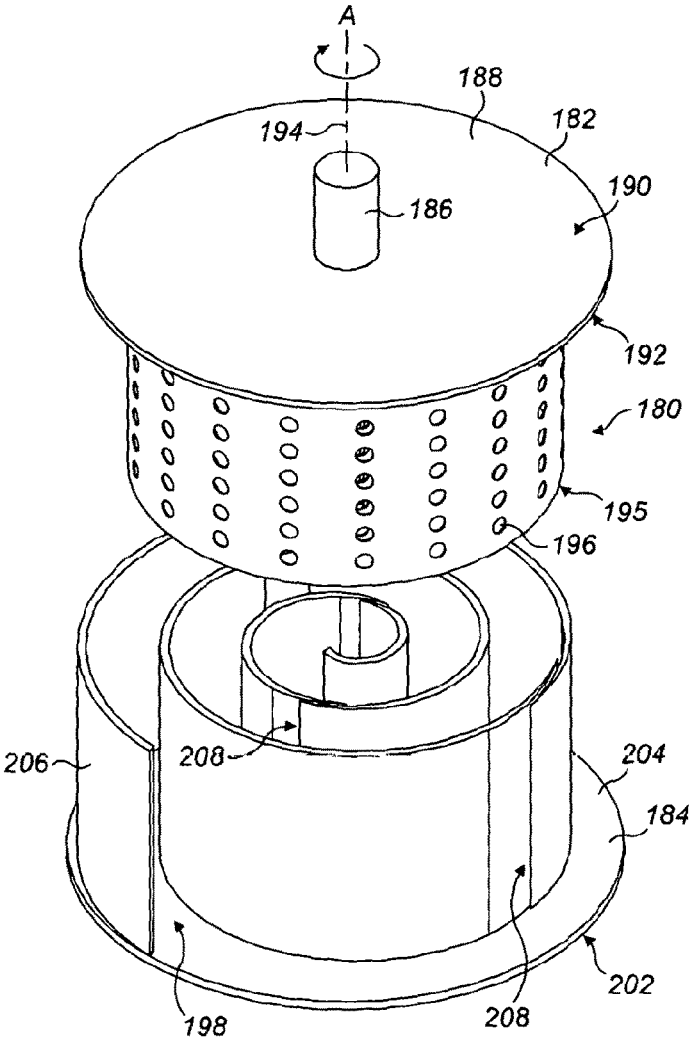
FIG. 9 is a schematic diagram of another embodiment of the present invention, shown in exploded view.

Referring to FIG. 9, a rotor element 182 is shown separated from a stator element 184 to assist with the explanation. The rotor 182 comprises a drive spindle 186 to which is mounted a disk-shaped member 188. The disk member 188 has a top surface 190 and bottom surface 192. The rotor is arranged to rotate about the axis 194 as indicated by the arrow. A series of concentric perforated skirt elements 195 are arranged to extend from the bottom surface of the disk member. An array of perforations 196 are arranged through each skirt to allow gas to flow through the skirt between an outer and inner section. In FIG. 9 only one skirt is visible.

A stator element 184 is arranged to cooperate with the rotor and, during use, urge gas from an inlet 198 towards an outlet 200. The stator element comprises a disk member 202 having an upper surface 204, which faces the bottom surface 192 of the rotor's disk member. A wall 206 extends up from the top surface by a distance that is the same as the axial length of the rotor's skirt member 195. Slots 208 are arranged in the wall to accommodate the rotor skirt elements. The surfaces of the wall 206, upper surface 204 of the stator disk and bottom surface 192 of the rotor disk define a flow channel arranged to guide gas molecules from the inlet 198 towards the pump's outlet 200. The flow channel has a spiral form in this embodiment and the channel is intersected with one or more rotor skirt elements 195 between the inlet and outlet.

Figure 10:
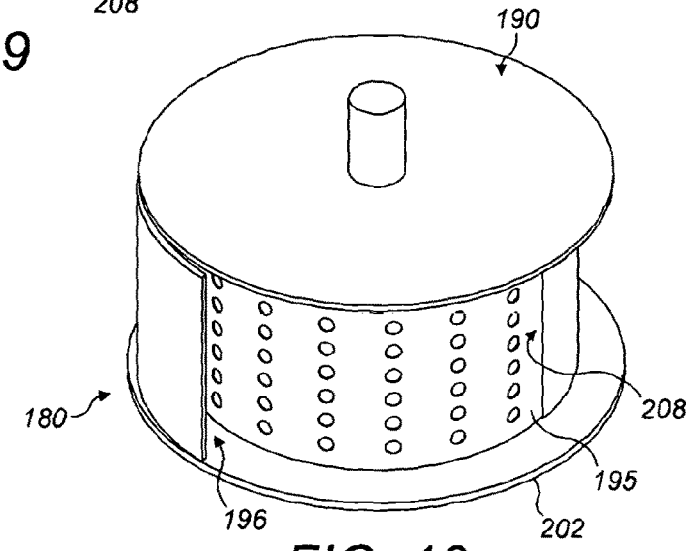
FIG. 10 is a schematic diagram of the embodiment of FIG. 9.
Figure 11:
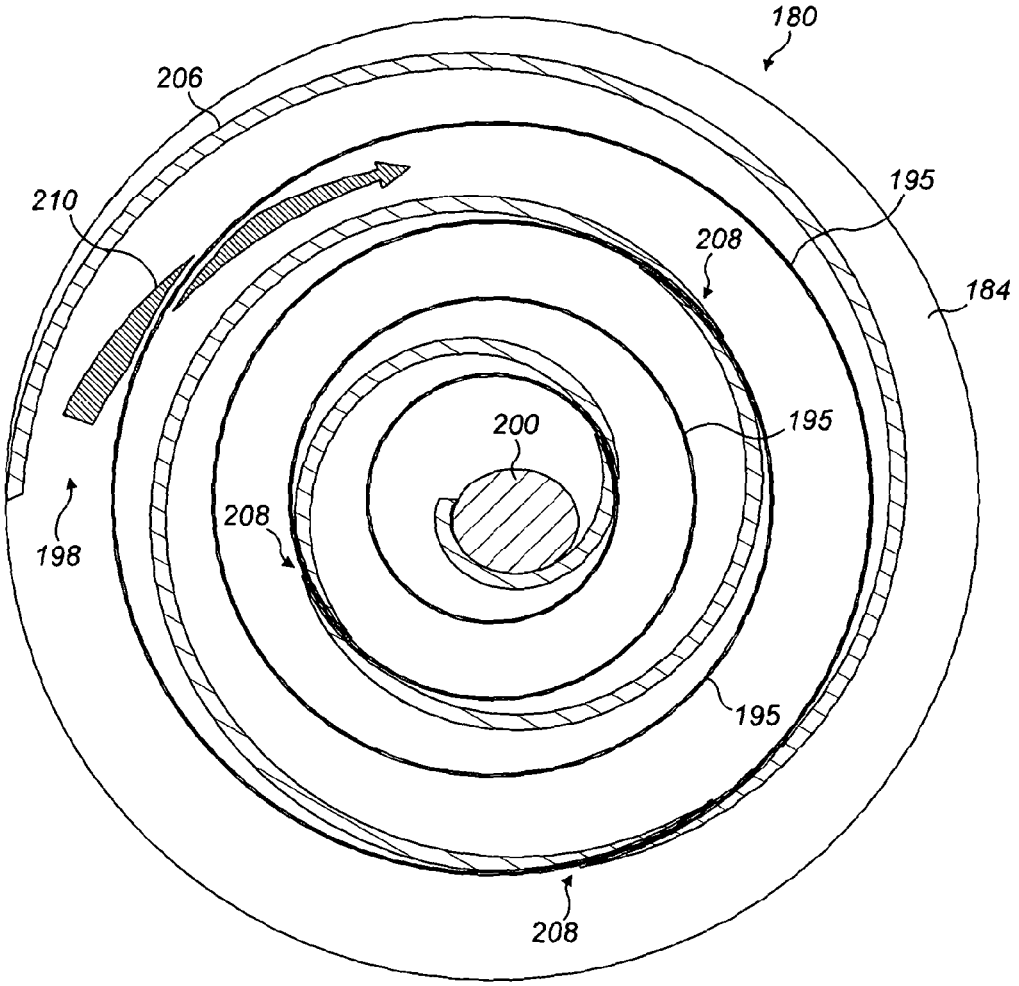
FIG. 11 is a cross-section of the pump mechanism shown in FIG. 10.
Figure 12:
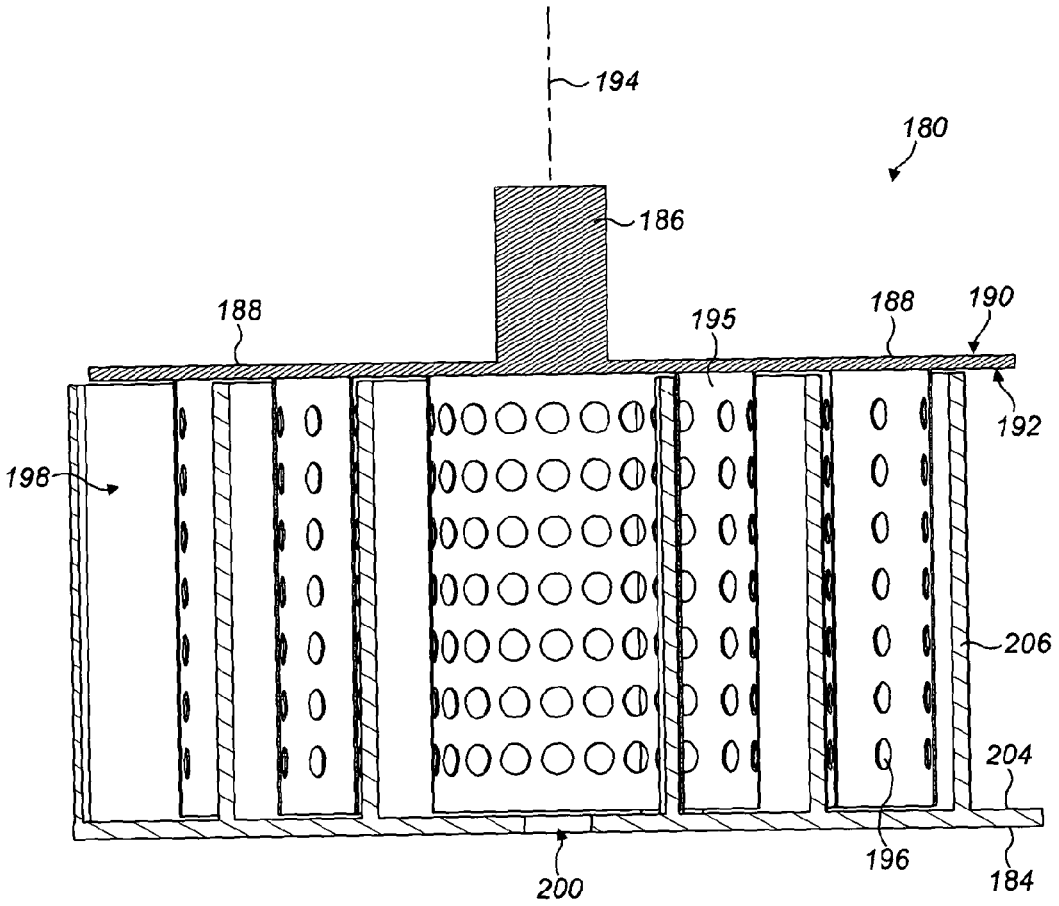
FIG. 12 is another cross-section of the pump mechanism shown in FIG. 10.

FIG. 11 shows an axial cross-sectional view of the assembled pump shown in FIG. 10. Here, the outlet 200 is visible in the centre of the stator. This arrangement lends itself to a pump design having subsequent pump mechanisms arranged downstream of the pump mechanism shown in the figure. In such an arrangement, multiple pumping mechanisms can be driven by a single motor to improve pump system efficiency. There are four rotor skirts shown in the figure, which are all arranged concentrically with one another and the axis of rotation 194. The gas flow path is shown by the arrow 210 and it is seen that the rotor skirt 195 intersects the flow path. FIG. 12 shows a radial cross-section of the pump mechanism shown in FIG. 10. The same reference numerals have been used to ease understanding.

During operation, relative movement of the rotor and stator elements is achieved by driving the rotor element with an electric motor whilst the stator element is held stationary in a suitable housing. Gas molecules in a chamber being evacuated migrate towards the inlet 198 and any molecules that interact with the rotating skirt's surfaces have their momentum influenced by the movement of the rotor. Thus, molecules are urged along the spiral flow path towards the outlet. Gas molecules are able to pass through the perforations in the rotor and onwards towards the outlet. The nature of the acute intersection angle (that is, the angle at which the rotor skirt intersects the gas flow channel, which is determined by the pitch of the spiral amongst other factors)

provides an efficient mechanism to compress the gas passing through the pump. Thus, a radial flow pump is provided by the third embodiment.

This embodiment operates with the same principles as described above and below. As such, similar design considerations should be taken into account when considering the parameters in which the pump is likely to operate. For instance, the thickness of the rotor skirt should be minimized to control the amount of gas carry-over. Likewise, the slot width should also be minimized for similar reasons. However, in this embodiment, the configuration of the skirt extending axially from a disk may cause an issue as the speed of the rotor increases; the rotor might increase in diameter during use because of the centripetal forces acting on the skirt, which is supported only at one end. Therefore, the designer might be limited to certain materials for manufacture of the rotor, including those that exhibit appropriate strength to weight ratios. Other features might be designed into the rotor to assist with strengthening the rotor appropriately. For instance, the skirt can be tapered to have a thicker end at the point where it is mounted on to the disk member.

Figure 13:
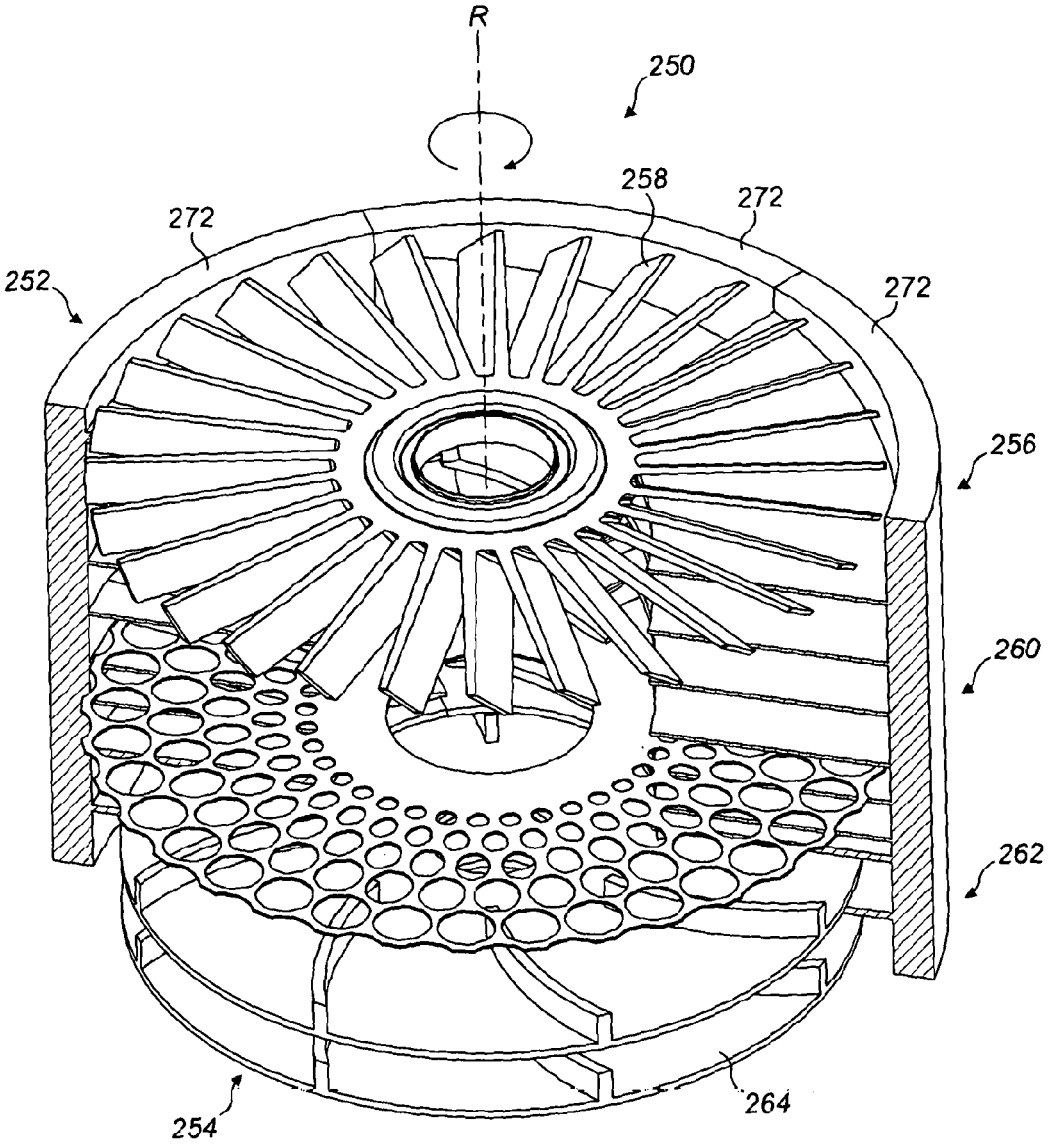
FIG. 13 is a schematic diagram of a further embodiment of the present invention, showing a compound pump incorporating the mechanism of the present invention.
Figure 14:
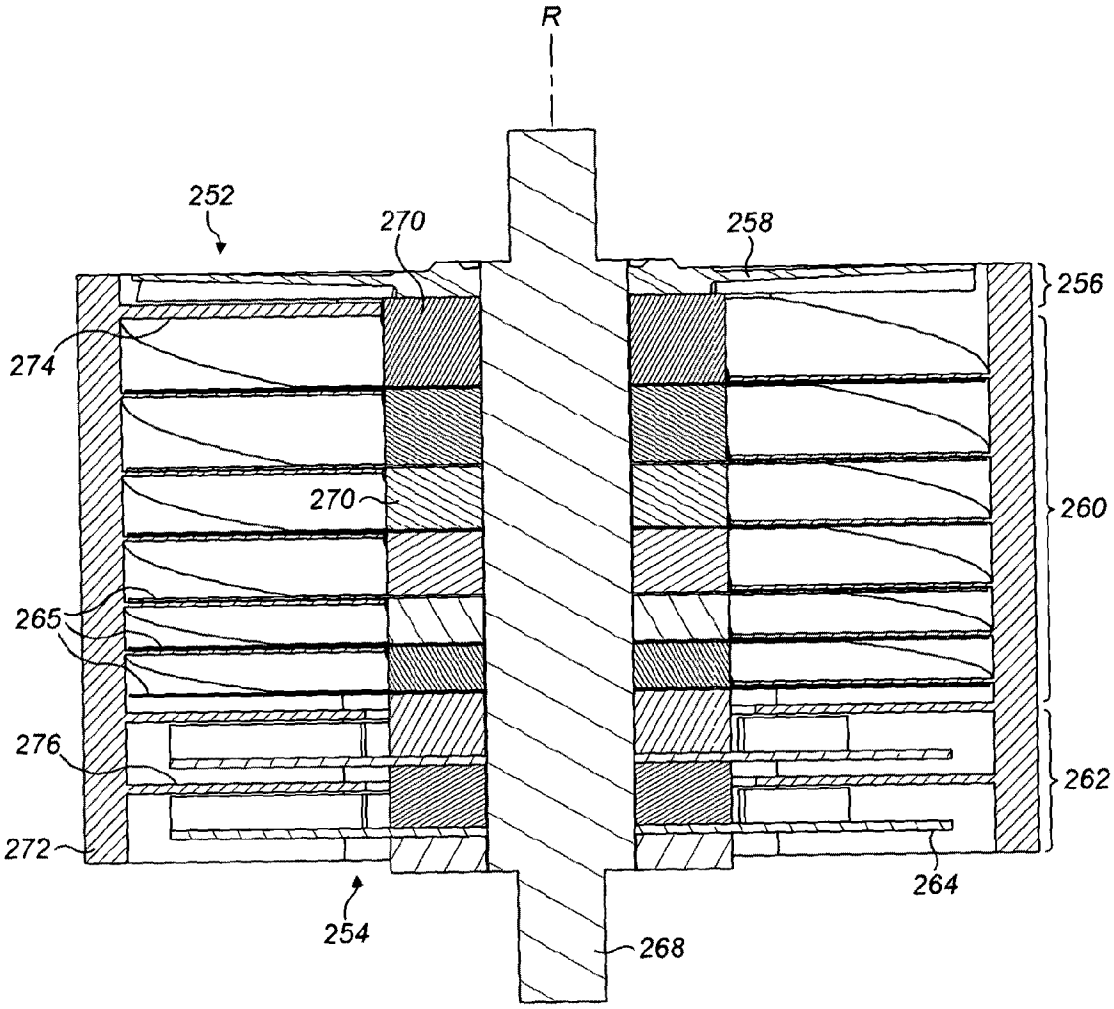
FIG. 14 is a cross-sectional diagram of the pump shown in FIG. 13.

Another alternative embodiment of the present invention is shown in FIGS. 13 and 14. Here, a vacuum pump mechanism 250 comprises three distinct stages to form a compound pump in which at least a part of the pump mechanism comprises the present inventive concept.

Referring to FIG. 13, the pump is shown in a cut-away form where a portion of the stator has been excluded from the figure. The pump comprises an inlet 252 and an outlet 254. An inlet stage 256 comprises one or more turbo-molecular rotor blade stages 258. A middle stage 260 comprises a vacuum pump mechanism according to the present inventive concept, as described in this document. An outlet stage 262 comprises one or more centrifugal pump stages 264. Rotor sections of the pump are arranged to rotor about an axis R, as indicated by the arrow. Of course, the inlet and outlet stages, 256 and 262 respectively, can be configured to any suitable pumping mechanism depending on the application and specific requirements of the pumps. For instance, the inlet stage is not limited to turbo-molecular pump mechanisms and the outlet stage is not limited to centrifugal mechanisms; the outlet stage might also comprise any one of a Gaede, Siegbahn, or Holweck mechanism or any combination of these types of pumping mechanisms for example. A regenerative or vortex aerodynamic pump mechanism might also be considered suitable. Furthermore, additional backing pumps can be provided at the outlet should the specification dictate the need for one.

FIG. 14 shows a cross-section of the pump taken along the axis of rotation R. All the rotor elements, namely the turbo-molecular blades 258, perforated rotor disks 265 and centrifugal rotor element 264 are mounted on a spindle or axle 268. Spacer elements 270 are disposed between the various rotor elements to hold the rotor elements in position. The stator 272 is formed of at least two segments positioned around the rotor to form the pump stator. The stator comprises the appropriate components 274 that form the gas flow channel as described previously. In addition, further stator components can be incorporated, such as necessary centrifugal stator components 276 and additional turbo-molecular stator components (not shown). Furthermore, each segment comprises the start of one gas flow channel and thus, in this arrangement, the number of segments is equivalent to the number of gas flow channels.

Figure 16:
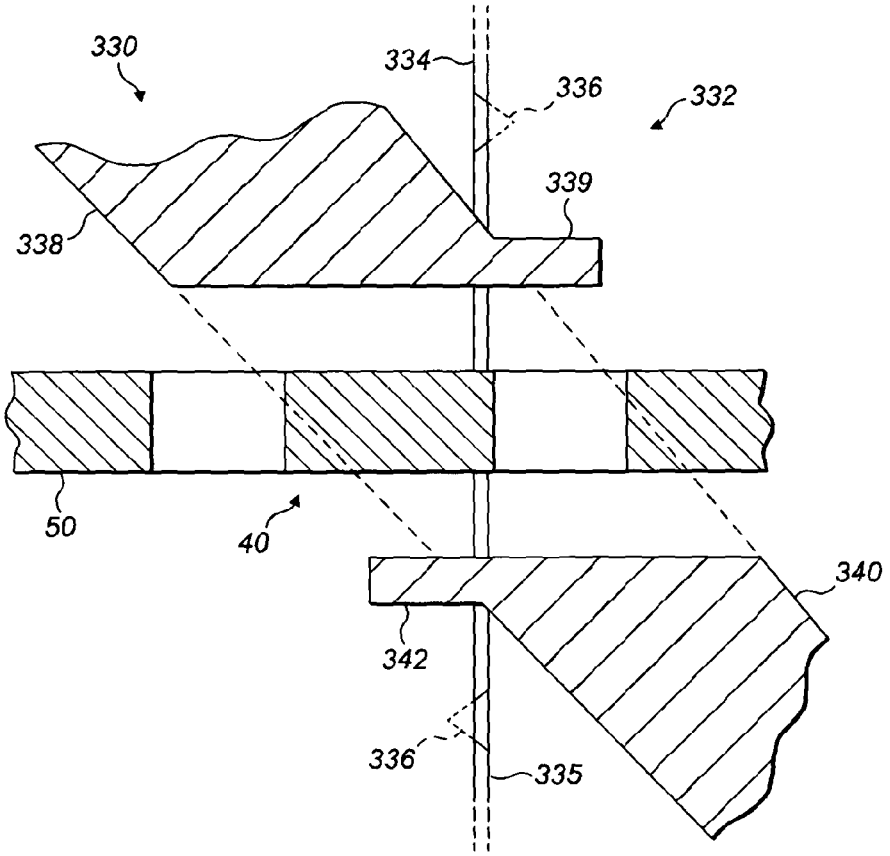
FIG. 16 is a cross-sectional area of a portion of a pump embodying the present invention.

In the embodiment shown in FIG. 13, the stator is made of six segments although only three are shown in this cut-away view. (Of course, such a segmented stator configuration can apply to any of the embodiments described in this document). Referring to FIG. 16, two segments 330 and 332 respectively, each have cooperating abutment surfaces 334 and 335 and means 336 for locating the segments in the desired configuration. The abutment surface or the location of the join between neighbouring segments 330 and 332 is arranged to coincide with the termination of section 338 of the gas flow channel side wall. A portion 339 of the gas flow channel can also be arranged to extend beyond abutment surface and to overhang across the join and cooperate with a neighbouring segment 332. Likewise, the initial part 342 of the gas flow channel sidewall 340 disposed downstream of the slot 40 can comprise an overhanging portion 342. As a result, the overhanging portions of the sidewall channel of each neighbouring segment are arranged to form, or extend the length of the slot that accommodates the rotor 50.

Figure 15:
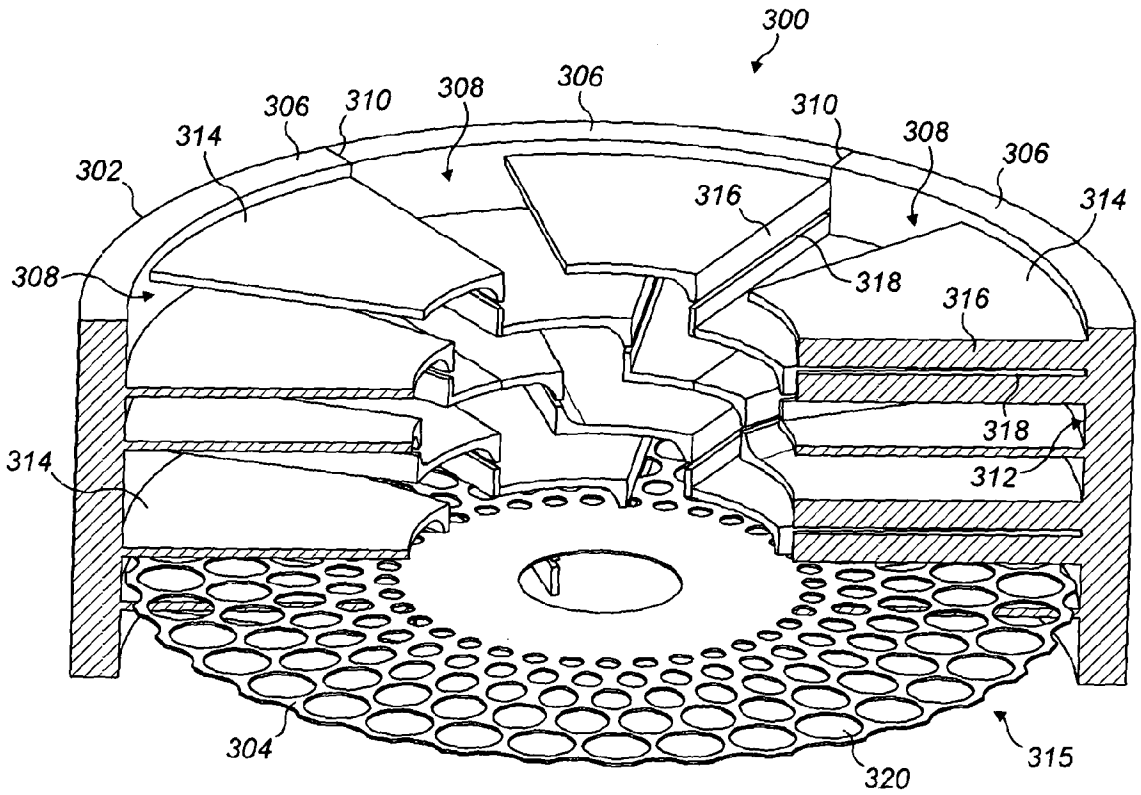
FIG. 15 is a schematic diagram of another embodiment of the present invention.

FIG. 15 shows another configuration of a pump embodying the present invention. Here, the pump mechanism 300 is shown in a cut-away form to help with understanding the inventive concept; one half of the stator 302 is shown and only one rotor disk 304 is shown. The rotor axel and additional rotors are not shown in this drawing.

The stator is made of six segments 306, three of which are shown in FIG. 15. Each stator segment comprises an inlet 308, thereby providing a six-start pump mechanism when assembled. In this embodiment, the stator segments are abutted to one another to join along an abutment surface 310. The assembled stator is generally cylindrical in shape, and an inner cylindrical surface 312 provides a floor of the gas flow channel. A plurality of channel walls is formed by a series of radial members 314 extending inwards from the inner cylindrical surface. Together, the walls and channel floor define a gas flow channel which extends between the inlets 308 and outlet 315 at the base of the cylinder in FIG. 15. The gas flow channel is generally helical in shape, but it follows a step profile due to the configuration of the walls 314. As such, the flow channels have sections following in a circumferential direction and sections that follow an axial or longitudinal direction. The longitudinal portion 316 of the wall comprise a slot 318 arranged to accommodate a perforated rotor disk 320, similar to the type already described above. In this embodiment, the rotor disk 320 intersects the general direction of the flow channel at an acute angle but passes perpendicularly through the channel wall.

Figure 20:
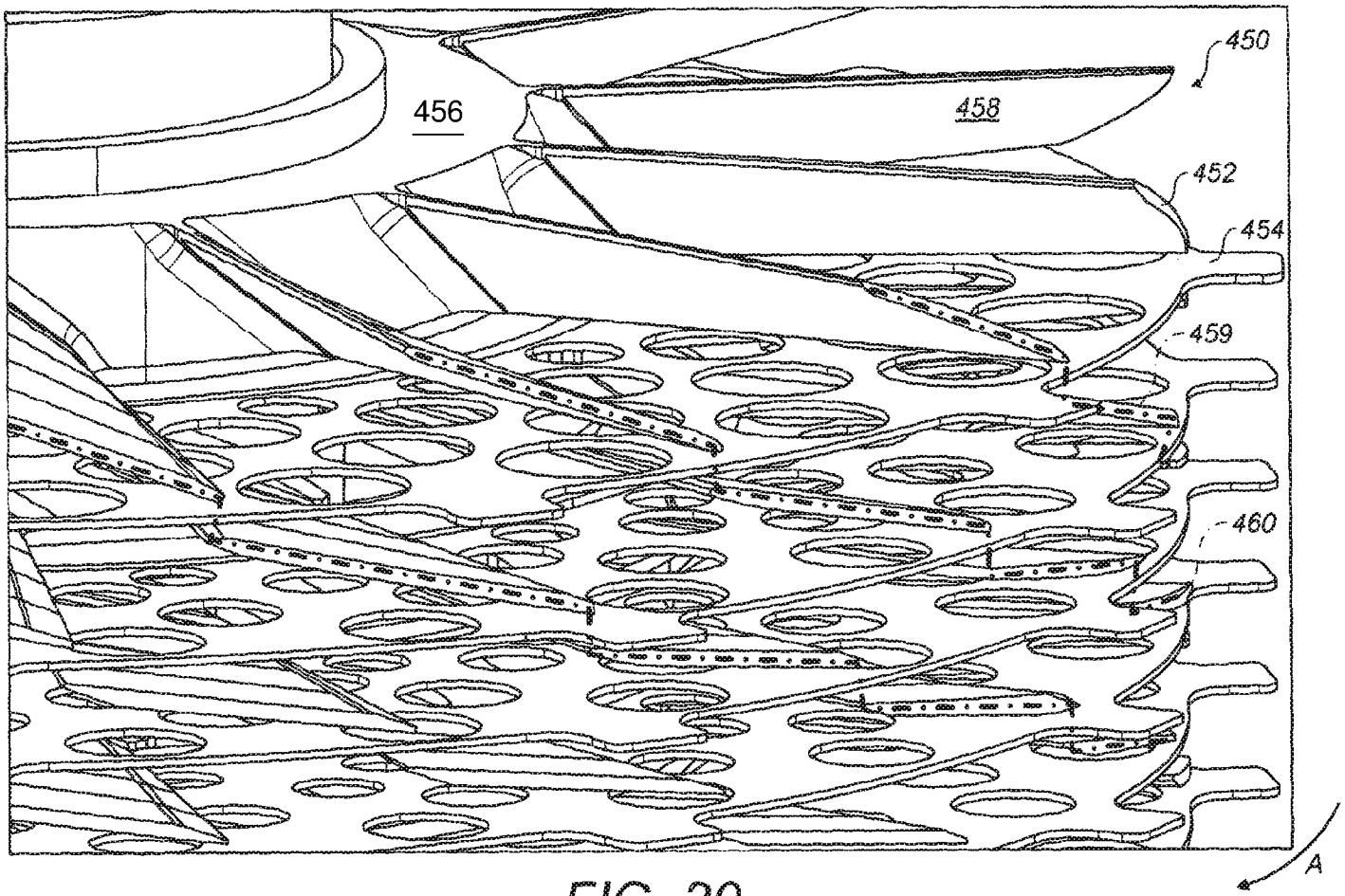
FIG. 20 is a schematic diagram of a portion of a further alternative embodiment of the present invention.
Figure 21:
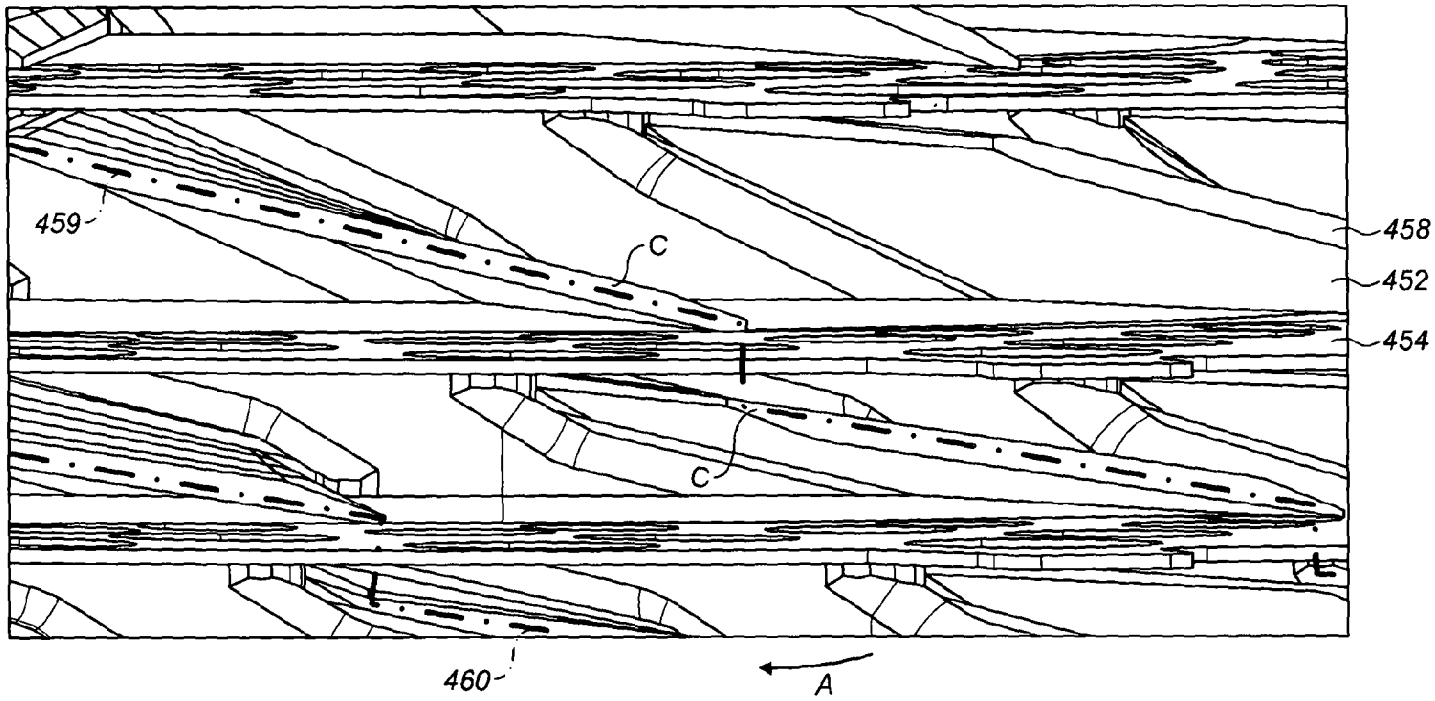
FIGS. 21 to 22 are schematic diagrams showing components of the embodiment of FIG. 20.
Figure 22:
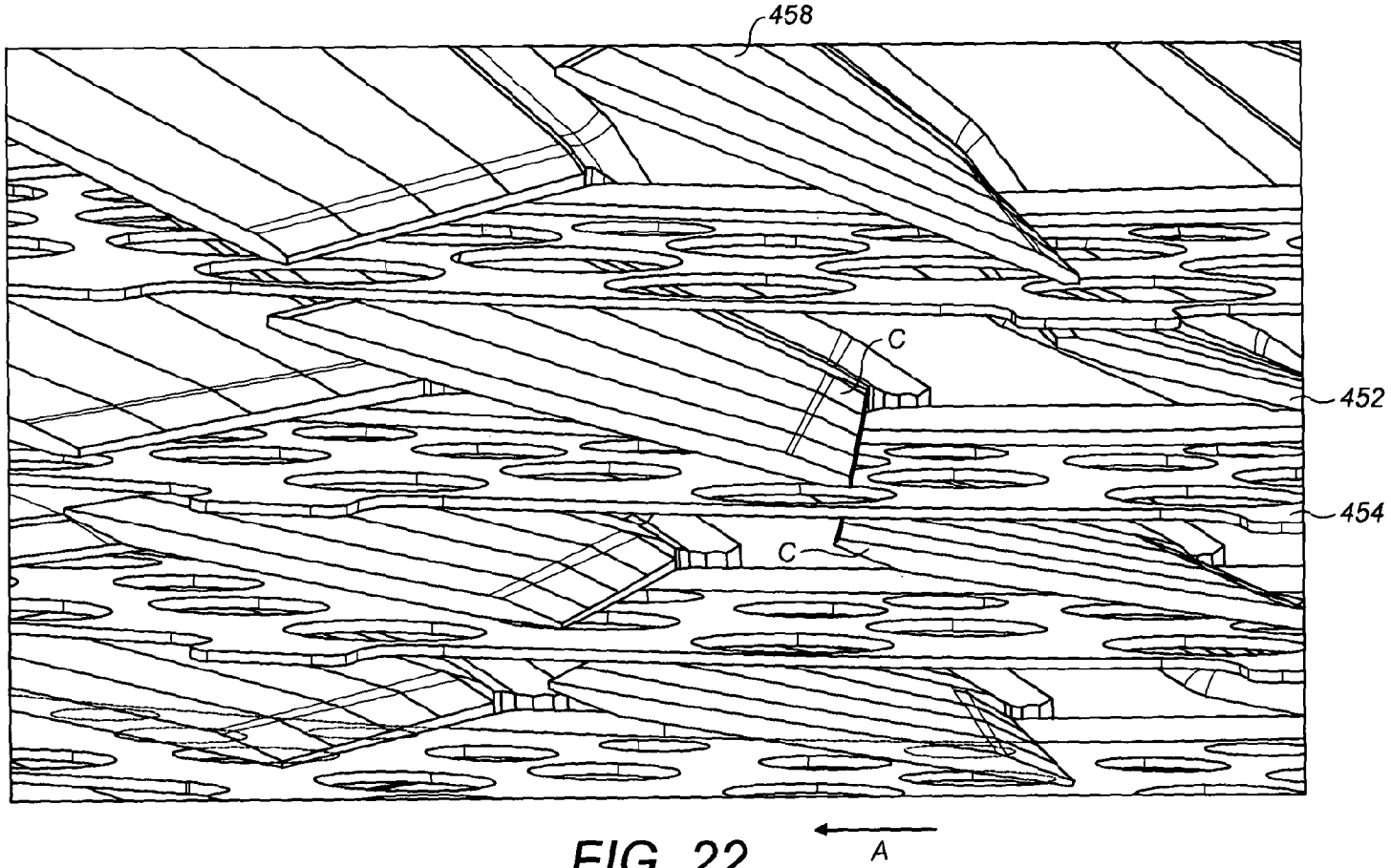

Referring to FIGS. 20 to 22, a further additional embodiment of the present invention is provided. In FIG. 20, the pump mechanism 450 comprises a rotor element 452 and stator element 454, based on the same principles of the mechanism shown in FIG. 8. As described above, gas molecules enter the mechanism or device at the top of the channel and are urged, during pump operation, towards the bottom of the channel as illustrated. In this embodiment, the rotor element comprises fourteen channels passing in a helical path around a hub 456. The channels are defined by angled fins or vanes 458 extending from the hub in a radial direction and each channel is intersected by a flat perforated mesh element 454 which extends around the hub and across the width of the channel Stages of the pump are arranged in series whereby each stage is defined by a series of vanes extending radially and are intersected by the stator element. In general, adjacent rotor elements are aligned to form a continuous channel intersected by one or more stator elements comprising a perforated disk. Dotted lines 459 and 460 indicate the path of the channel and illustrate the helical nature of the channel. The channel narrows towards the outlet and hence the angle of the vanes flattens towards the outlet. The perforated element has a constant radial and circumferential opacity, having circular apertures arranged in a regular pattern. The diameter of each aperture increases towards the outer edge of the stator element. The rotor is driven in a rotational direction, as indicated by arrow A.

Referring to FIG. 21, a chamfer C is formed on the leading and trailing edges of the vanes to improve pump efficiency. The chamfer reduces the length M of the slot through which the stator intersects the channel (as also set out in FIG. 6) in an attempt to reduce any turbulent flow that might occur as a result of the gas molecules passing through the slot in the vanes accommodating the perforated stator element.

In addition, the trailing edge of a vane on the upstream side of the mesh element is disposed in the same radial position as the adjacent leading edge of the vane on the downstream side of the mesh rotor. This arrangement results in a step being formed in the helical channel at a point where the mesh element intersects the channel Our experiments have shown that this arrangement provides an efficient vacuum pumping mechanism where the gap arranged to accommodate the mesh element in between adjacent elements defining the helical channel is minimized.

The rotor can be mounted using active and/or passive magnetic levitating bearings of the kind already used in known turbomolecular vacuum pumps. In such instances, it is important that sufficient space is provided to accommodate the mesh stator element between channel vanes as the rotor is accelerated or decelerated. Rotors mounted on magnetic bearings can experience axial movement during start-up or shut-down phases of the pump's operation and so sufficient space is required to accommodate this movement and reduce or prevent clashing of pump parts. Of course, it is important to maintain the slot width at a minimum in order to reduce the likelihood of gas carry-over between adjacent channels. The surfaces of the vanes facing the mesh element can be provided with an up-standing, sacrificial element or coating that is displaced or abraded during the operational cycle of the pump (for instance, abrasion might occur during pump testing prior to shipping from the manufacturing site) to ensure that the gap is minimized. However, any resulting waste material should be easily cleared from the pump.

The present invention differs from known pump mechanisms in many ways. For instance, known drag mechanisms (such as Holweck, Siegbahn or Gaede mechanisms) operate with the rotor and stator elements arranged in the same plane or arranged concentrically. In the present invention described herein it is clear that the rotor and stator elements do not comply with this general principle but, in contrast, the rotor and stator elements are arranged to intersect with one another. For example, where the gas flow path is defined by a helical channel in the stator generally along the axis of the pump, the rotor is arranged in a general radial configuration that intersects the channel and allows gas to flow through the rotor in order to follow the axial flow path.

Furthermore, embodiments of the present invention differ from known turbomolecular pumps in that either the stator or rotor (depending on the configuration used) is flat and much thinner than the other complementary element. Momentum can be transferred to gas molecules by the interaction of the molecule and the upper or lower surfaces of a spinning disk rotor, in contrast to turbo blades that operate differently whereby the stator and rotor blades are typically identical save for the stator blades being arranged to face in the opposite direction to the rotor blades.

Figure 23:
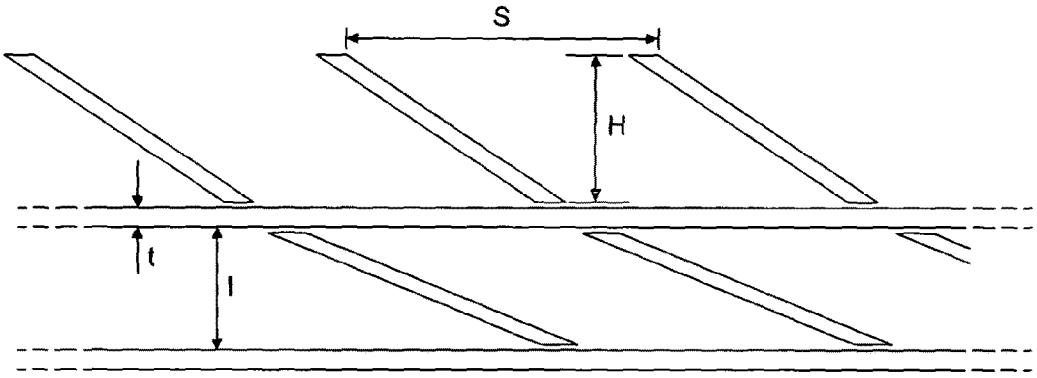
FIG. 23 is a schematic diagram of various parameters of components of a pump embodying the present invention.

Referring to FIG. 23, the space chord ratio of the vanes embodying the helical channel of the present invention should be greater than or equal to 4, preferably 5 or above. At the exhaust stages of a pump, the space chord ratio should preferably be greater than 5, preferably 6 or more. The space chord ratio is a known measure used by turbomolecular pump designers and is taken as the ratio of the circumferential distance S between leading edges of adjacent vanes (typically measured at a point half way along the vane) to the axial height H of the vanes. In other words, the pump comprises a plurality of vanes extending from the channel member defining the helical channel and the vanes are arranged in stages along the channel member's axis whereby the stages are separated by intersecting elements or disks, that is an intersecting element is disposed between adjacent stages. The space chord ratio of vanes within the same stage is greater than or equal to 4.

Additionally, the aspect ratio of the thickness and diameter of the perforated element in disk form should be arranged to be less than 0.02 and preferably less than 0.01. In other words, the axial thickness of a perforated disk element (whether it is acting as stator or rotor) should be less than $1/50^{th}$ of the disk's diameter, more preferably $1/100^{th}$ the diameter. Furthermore, the ratio of the disk's thickness to the spacing between adjacent disks should be less than 0.10. In other words, the ratio of t:l (also with reference to FIGS. 4 and 6 respectively) should be at least 1:5 or more, preferably 1:10 or more, most preferably 1:20 or more depending on the pump characteristics. As a result, the disks are spaced apart along the axis of the channel member in series by a distance l and this spacing is at least ten times the axial thickness of the disk. Typically, known turbomolecular pumps are arranged such that adjacent rotor and stator elements have the same or similar dimensions.

Further embodiments and adaptations of the present invention will be envisaged by the skilled person without leaving the scope of the inventive concept, as defined in the accompanying claims. For example, the pump mechanism could comprise an inter stage section in between pump stages to enable a so-called split flow configuration. In other words, the pump could have two or more discrete inlets disposed along the axial length so that the pump can evacuate chambers at different pressures as if often required by differentially pumped mass spectrometry devices.

Additionally, it is to be understood that a pump can be configured such that the perforated rotor disk intersects the gas flow channel at the end of the gas flow channel. In other words, the rotor is located at the very end of the channel and the channel wall does not extend beyond the rotor to a position downstream of the rotor. In this configuration, the slot in the channel wall is not required. However, the end of the wall closest to the rotor should be disposed as close as possible to the surface of the disk nearest to the channel wall. This arrangement also allows for modular construction of the pump elements which can be stacked one on top of the other to form a multiple stage pump.

Furthermore, all the embodiments disclosed above are arranged with the gas flow channel walls arranged in alignment either side of the intersecting rotor. However, the channel wall alignment is not essential for the pump to operate. For example, particularly when operating in the molecular flow pressure regime, misalignment of gas flow channel walls on either side of the rotor would not preclude the operation of the pump. The gas molecules would still be able to pass through the perforated rotor and into the next downstream section.

Additionally, the thickness of the perforated element might taper towards the outer edge, or towards the edge disposed furthest from the point at which the perforated element is coupled to or adjoins the drive shaft or axle. Therefore, in the case of a tapering rotor disk, the upstream and downstream surfaces are formed as a very shallow cone having an apex angle approaching 180°. In other words, the tapered disk is configured as two shallow cones mounted back-to-back to form a disk having a thickness that is largest at the centre and tapers towards the peripheral edge of the disk. For the purposes of this document, the upstream and downstream surfaces are said to be flat even when a tapering perforated element is utilized. The same applies if a tapering cylindrical perforated element is utilized, in which case the upstream and downstream surfaces are considered to be in the plane of a cylinder even if a cross-sectional taper is provided for the perforated element.

Yet further, a pump comprising multiple intersecting elements can be configured to comprise intersecting elements having different transparency values throughout the pump, including intersecting members or elements having a transparency value of zero (that is, solid elements arranged to have a gap disposed between the inner or outer circumferential edge of the intersecting member and the channel floor). The number, location and variety of intersecting elements depend on the design and application of a pump. For instance, a solid intersecting member might be used if the pump is expected to transfer corrosive gases that could alter the transparency of a perforated intersecting element as a result of corrosive removal of the material around the perforations, increasing the aperture size of perforations. Alternatively, a solid intersecting member can be used if a large amount of dust or condensable material is expected to be entrained in the gases being pumped whereby deposits on the intersecting element could clog perforations.

Furthermore, the use of a solid intersecting member can be advantageous if the pump designer needs to provide an intersecting member that has minimal carry-over volume. Still further, the solid intersecting member is relatively easy to make and cheaper to procure or handle during manufacturing or servicing processes. Additionally, it is likely that solid intersecting members might be used in high pressure vacuum pumps or high pressure stages (which are at or below atmospheric pressure) or in exhaust stages of a multiple stage pump where the volume of gas passing through the exhaust stages is lower than the volume of gas entering the pump as a result of gas compression within the pump. Thus, gas molecules can be transferred around the inner or outer peripheral edge of the intersecting member and perforation apertures might not be required for efficient pumping.

Taking account of the foregoing and current state of the art, we believe the present inventive concept makes a significant contribution to vacuum pump technology and mechanisms based on the present invention should take the name of the principle inventor. As such, embodiments of the present invention can subsequently be referred to as Schofield pumps.

The invention claimed is:

1. A vacuum pump having a mechanism comprising;

a first intersecting element and a second intersecting element axially separated from each other along a rotational axis of the pump and arranged to intersect a helix channel formed on a surface of a channel member, said helix channel being arranged to guide gas molecules from an inlet of the pump towards an outlet, wherein the first and second intersecting elements and channel member are arranged to move relative to one another so that, during use, gas molecules are urged along the channel towards the outlet, said first and second intersecting elements being arranged to allow gas molecules to pass through or around the first and second intersecting elements, and each of the first and second intersecting elements has upstream and downstream surfaces arranged to interact with gas molecules and said surfaces are in the plane of the respective intersecting element and are free of protrusions.

2. The vacuum pump according to claim 1, wherein the channel member comprises a plurality of slots, disposed in a wall of the helix channel, arranged to accommodate the intersecting elements near respective points where the intersecting elements intersect the helix channel.

3. The vacuum pump according to claim 2, wherein each slot extends across a depth of the helix channel so that each intersecting element can divide the helix channel at the point where the respective intersecting element intersects the helix channel.

4. The vacuum pump according to claim 3, wherein the first intersecting element comprises a peripheral edge and, either a gap is provided between the peripheral edge of the first intersecting element to allow gas to pass the first intersecting element, or perforations in the first intersecting element are open at the peripheral edge.

5. The vacuum pump according to claim 4, wherein either the gap is arranged to extend around a majority of the peripheral edge, or the perforations open at the peripheral edge of the first intersecting element extend in a radial direction towards an inner circumferential edge, whereby portions of the upstream and downstream surfaces disposed between the perforations extend towards the peripheral edge to form a flat radial vane.

6. The vacuum pump according to claim 3, wherein the first intersecting element comprises an annular portion in which a plurality of perforations is disposed and a transparency of the annular portion varies in either a radial direction or a longitudinal direction.

7. The vacuum pump according to claim 6, wherein the transparency increases with respect to increasing radial distance from a center of the first intersecting element.

8. The vacuum pump according to claim 6, wherein the transparency varies as a function of either varying the size of perforation, varying the angular spacing of perforation, varying the circumferential spacing of perforations, or any combination thereof.

9. The vacuum pump according to claim 1, wherein the channel member is cylindrical and the channel is formed on an inner surface to form a helical gas flow path between the inlet and outlet disposed at opposing ends of the channel member.

10. The vacuum pump according to claim 9, wherein the pump further comprises a plurality of vanes extending from the channel member thereby defining the channel as helical, the vanes being arranged in stages having an intersecting element disposed between adjacent stages, and wherein a space chord ratio of vanes within the same stage is greater than or equal to 4.

11. The vacuum pump according to claim 10, wherein the space chord ratio of vanes at a last stage before the outlet is at least 5.

12. The vacuum pump according to claim 1, wherein the first intersecting element comprises a disk having the upstream and downstream surfaces, wherein the upstream and downstream surfaces are in the plane of the disk.

13. The vacuum pump according to claim 1, wherein the first and second intersecting elements are spaced apart along the axis of the channel member in series by a distance l, each intersecting element has a thickness t, and the ratio of l:t is at least 5:1.

14. The vacuum pump according to claim 1, wherein the first intersecting element has a thickness that is less than 0.02 times its diameter.

15. The vacuum pump according to claim 1, wherein the upstream and downstream surfaces of the first intersecting element transfer momentum to the gas molecules.

16. The vacuum pump according to claim 1, wherein the first intersecting element has thickness of less than 2 mm.

17. The vacuum pump according to claim 1, further comprising a spindle that is coupled to the first intersecting element, said spindle being arranged coaxially with the first intersecting element.

18. The vacuum pump according to claim 1, further comprising a turbo-molecular blade section disposed for use upstream of the first intersecting element.

19. The vacuum pump according to claim 1, further comprising a downstream pump section disposed for use downstream of the second intersecting element, said downstream pump section comprising any of a regenerative pump section, centrifugal pump section, Holweck, Siegbahn, or Gaede drag pump mechanisms, or any combinations thereof.

20. The vacuum pump according to claim 1, wherein the first and second intersecting elements are pump rotors and the channel member is a pump stator.

21. The vacuum pump according to claim 1, wherein the first and second intersecting elements are pump stators and the channel member is a pump rotor.

22. The vacuum pump according to claim 1 wherein the first intersecting element comprises perforations that are perpendicular to the upstream and downstream surfaces of the first intersecting element.

23. A vacuum pump comprising;

an inlet, an outlet, first and second intersecting members, a channel member, and a motor;

wherein the channel member comprises a surface having a helical channel formed thereon, said helical channel being arranged to guide gas molecules from the inlet towards the outlet, the first and second intersecting members are arranged to intersect the helical channel, the first and second intersecting members each comprise upstream and downstream surfaces which are free of protrusions, and the motor is arranged to cause movement of the first and second intersecting members relative to the channel member such that, during use, the relative movement causes gas molecules to be urged along the helical channel towards the outlet, said first and second intersecting members allowing gas molecules to respectively pass through the first and second intersecting members.

24. The vacuum pump according to claim 23 wherein the first intersecting member comprises perforations that are perpendicular to the upstream and downstream surfaces of the first intersecting member.

25. A vacuum pump having a mechanism comprising;

first and second intersecting elements axially separated from each other along a rotational axis of the pump and arranged to intersect a helical channel formed on a surface of a channel member, said helical channel being arranged to guide gas molecules from an inlet of the pump towards an outlet, wherein the first and second intersecting elements and the channel member are arranged to move relative to one another so that, during use, gas molecules are urged along the helical channel towards the outlet, said first and second intersecting elements each being arranged to allow gas molecules to pass through or around the respective first and second intersection elements, and the first and second intersecting elements each having upstream and downstream surfaces arranged to interact with gas molecules and said surfaces are in the plane of the intersecting element and are free of protrusions, wherein the first and second intersecting elements are arranged to extend across the channel to intersect a majority of the channel, whereby a respective gap is provided between the first and second intersecting elements and a portion of the channel such that, during use, gas molecules can pass through the gap, and wherein the first and second intersecting elements are solid without perforations.

* * * * *